US009045931B2

(12) United States Patent
Damen et al.

(10) Patent No.: US 9,045,931 B2
(45) Date of Patent: Jun. 2, 2015

(54) DECORATIVE MULTI-SLAT SYSTEM

(71) Applicant: 3form, Inc., Salt Lake City, UT (US)

(72) Inventors: Michael Damen, Rochetoirin (FR); Guillaume Martin, Rochetoirin (FR)

(73) Assignee: 3form, LLC, Salt Lake City, UT (US)

( * ) Notice: Subject to any disclaimer, the term of this patent is extended or adjusted under 35 U.S.C. 154(b) by 176 days.

(21) Appl. No.: 13/748,245

(22) Filed: Jan. 23, 2013

(65) Prior Publication Data

US 2013/0192772 A1 Aug. 1, 2013

Related U.S. Application Data

(63) Continuation-in-part of application No. 29/411,794, filed on Jan. 26, 2012, now Pat. No. Des. 685,114, and a continuation-in-part of application No. 29/411,835, filed on Jan. 26, 2012, now Pat. No. Des. 698,231.

(60) Provisional application No. 61/591,180, filed on Jan. 26, 2012.

(51) Int. Cl.

| | |
|---|---|
| ***E04B 2/00*** | (2006.01) |
| ***E06B 9/00*** | (2006.01) |
| ***E06B 9/04*** | (2006.01) |
| ***E04B 9/36*** | (2006.01) |

(52) U.S. Cl.
CPC ... *E06B 9/00* (2013.01); *E06B 9/04* (2013.01); *E04B 9/366* (2013.01)

(58) Field of Classification Search
CPC ..... E04C 2/425; E04C 2/423; E01D 19/125
USPC ..... 52/664, 653.1, 668, 660, 669, 673, 52/650.3, 661, 663, 666, 506.06
See application file for complete search history.

(56) References Cited

U.S. PATENT DOCUMENTS

| | | | | |
|---|---|---|---|---|
| 2,084,118 | A * | 6/1937 | Zabriskie | 52/667 |
| 2,252,533 | A | 8/1941 | Tench | |
| 2,384,303 | A * | 9/1945 | Heath | 52/668 |
| 2,645,985 | A * | 7/1953 | Beebe et al. | 52/667 |
| 2,656,168 | A | 10/1953 | Ayres | |
| D187,620 | S | 4/1960 | Logan | |
| 3,267,628 | A | 8/1966 | Seery | |
| 3,396,497 | A | 8/1968 | Murphy | |
| D241,007 | S | 8/1976 | Solo | |
| 3,982,307 | A | 9/1976 | Smith | |
| 4,027,451 | A * | 6/1977 | Bustin | 52/664 |
| 4,532,749 | A * | 8/1985 | Perk | 52/668 |
| 4,807,334 | A | 2/1989 | Blanchard | |

(Continued)

OTHER PUBLICATIONS

Notice of Allowance for U.S. Appl. No. 29/411,794 mailed May 7, 2013.

(Continued)

*Primary Examiner* — Mark Wendell
(74) *Attorney, Agent, or Firm* — Workman Nydegger

(57) ABSTRACT

Implementations of the present invention relate to devices, systems, and methods related to mounting decorative slats. In particular, the present invention facilitates accurate mounting and installation of a decorative multi-slat system, which can provide aesthetic enhancement for a particular space. Furthermore, the method of installing the decorative multi-slat system can allow an installer to reduce likelihood of errors and misalignments of the system, which can occur during the installation.

26 Claims, 12 Drawing Sheets

(56) References Cited

U.S. PATENT DOCUMENTS

| | | | | | |
|---|---|---|---|---|---|
| 4,835,824 | A | | 6/1989 | Durham | |
| 4,839,947 | A | | 6/1989 | Cohen | |
| 5,159,730 | A | | 11/1992 | Radvin | |
| D332,047 | S | | 12/1992 | Kluk | |
| 5,463,786 | A | * | 11/1995 | Mangone et al. | 14/73 |
| D367,223 | S | | 2/1996 | Adams | |
| D374,727 | S | | 10/1996 | Emanuele | |
| D393,588 | S | | 4/1998 | Tuthill | |
| D426,767 | S | | 6/2000 | Meyers | |
| D512,521 | S | | 12/2005 | Gulbrandsen | |
| D521,658 | S | | 5/2006 | Gulbrandsen | |
| 7,832,172 | B2 | * | 11/2010 | Bartley et al. | 52/664 |
| 8,011,157 | B2 | * | 9/2011 | Bartley et al. | 52/664 |
| 8,122,674 | B2 | * | 2/2012 | Bartley et al. | 52/664 |

OTHER PUBLICATIONS

Notice of Allowance for U.S. Appl. No. 29/452,948 mailed Jul. 8, 2013.

* cited by examiner

DECORATIVE MULTI-SLAT SYSTEM

CROSS-REFERENCE TO RELATED APPLICATIONS

The present application claims the benefit of priority to U.S. Provisional Patent Application No. 61/591,180, filed Jan. 26, 2012, entitled "Decorative Multi-Slat System." The present application also claims the benefit of priority to and is a continuation-in-part of: U.S. Design Application No. 29/411,794, filed Jan. 26, 2012, entitled "MULTI-SLAT ARCHITECTURAL PANEL SYSTEM" and U.S. Design Application No. 29/411,835, filed Jan. 26, 2012, entitled "INTEGRATED PANEL CLIP." The entire content of each of the above-referenced applications is incorporated herein by reference.

BACKGROUND OF THE INVENTION

1. The Field of the Invention

This invention relates to systems, methods, and apparatus for mounting and/or displaying panels.

2. Background and Relevant Art

Recent trends in building and interior design have implemented synthetic, polymeric resins, which may be used as doors, partitions, barriers, displays, shelving, tables, and other structures. Generally, resin materials are now popular compared with decorative cast or laminated glass materials, since resin materials can have higher strength and/or impact resistance than a similar transparent, translucent, or colored laminated glass. Decorative panels also can provide more design flexibility than, for example, glass panels. Furthermore, decorative resins provide a wide range of uses, since they can include a large variety of artistic colors, images, shapes, and other aesthetic impressions.

Designers and builders typically use various mounting systems to display various panels, including thermoplastic resin panels, in desired configurations. An installer can use posts to secure the panels in an upright position to form a partitioning system. Similarly, an installer can make shelving units by securing the desired panels horizontally to the post modules. Conventional mounting systems, however, present numerous challenges with various types of installations. For example, the designer desiring to install multiple panels, such as slats, at predetermined positions along a support surface, typically relies on the skill of the installer and may not be able to ensure the desired installation.

Accordingly, there are a number of disadvantages in mounting and displaying panels and slats that can be addressed.

BRIEF SUMMARY OF THE INVENTION

Implementations of the present invention provide systems, methods, and apparatus for mounting and displaying decorative panels and slats. One or more implementations provide a decorative slat that can couple to one or more support rails. Such decorative slats can present a viewer with a pleasing aesthetic. The decorative slats also can form a decorative multi-slat system that can further enhance overall aesthetic of a particular space. Moreover, the decorative multi-slat system can help a designer to ensure a proper installation of the decorative slats, according to a predetermined design. The decorative multi-slat system and method also can facilitate proper and accurate installation of the decorative slats, in accordance with the predetermined design.

At least one implementation includes a decorative multi-slat system for use in an architectural environment to provide, among other things, a pleasing aesthetic to viewers. Such system includes a support surface and a plurality of support rails secured to the support surface, each support rail of the plurality of support rails having a plurality of slits passing therethrough. Additionally, the system includes a plurality of decorative slats. Each decorative slat of the plurality of decorative slats is positioned within corresponding slits of the plurality of slits. Furthermore, each of the decorative slats is fixedly coupled to the plurality of support rails. Also, each of the one or more decorative slats is coupled to the plurality of support rails at a predetermined position, and each of the one or more decorative slats is coupled to the plurality of support rails at a predetermined orientation relative to the plurality of support rails.

Implementations of the present invention also include a method of installing a decorative multi-slat system. The method includes attaching a first support rail to a support surface and securing one or more second support rails to one or more decorative slats, the one or more second support rails being detached from the support surface. The method also includes securing the one or more decorative slats to the first support rail. Moreover, the method includes attaching the one or more second support rails to the support surface.

One or more implementations include a decorative slat configured for coupling to one or more support rails. The decorative slat incorporates a material sheet having a back edge and a plurality of cutouts in the material sheet near and passing through the back edge thereof. The decorative slat also includes a plurality of connection elements coupled to or integrated with the material sheet. Each of the plurality of connection elements is sized and configured to couple the material sheet to the one or more support rails. The decorative slat further includes at least one centering element coupled to or integrated with the material sheet. The at least one centering element is sized and configured to press against at least one support rail of the one or more support rails in a manner that positions the material sheet at a predetermined position relative to the one or more support rails.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which:

FIG. 3C illustrates another cross-sectional view of the support rail of

FIG. 3A taken along the line 3C-3C of FIG. 3A;

DETAILED DESCRIPTION OF THE PREFERRED EMBODIMENTS

Implementations of the present invention provide systems, methods, and apparatus for mounting and displaying decorative panels and slats. One or more implementations provide a decorative slat that can couple to one or more support rails. Such decorative slats can present a viewer with a pleasing aesthetic. The decorative slats also can form a decorative multi-slat system that can further enhance overall aesthetic of a particular space. Moreover, the decorative multi-slat system can help a designer to ensure a proper installation of the decorative slats, according to a predetermined design. The decorative multi-slat system and method also can facilitate proper and accurate installation of the decorative slats, in accordance with the predetermined design.

In at least one implementation, the decorative panels or slats can include locating sections, which can couple to one or more support rails. For instance, the decorative slats and the support rails can couple at predetermined locations. Moreover, the decorative slats can have various elements that can secure the decorative slats to the support rails. For example, the decorative slats can snap to the support rails at predetermined locations, chosen by a manufacturer or designer.

A plurality of decorative slats coupled to one or more support rails can form a decorative multi-slat system. In particular, the designer can choose specific desired arrangements (i.e., lateral position, vertical position, spacing, etc.) of the decorative slats. Such system can provide various aesthetically pleasing designs, as may be desired by a builder or an occupant of a space. Moreover, the decorative multi-slat system can provide additional support and/or rigidity to the support surface or structure. Accordingly, the builder can install such system for aesthetic and/or structural improvements to the space.

The builder can assemble and secure the decorative multi-slat system on a support surface, as described above. At least one implementation provides a method of installing the decorative multi-slat system, which can ensure proper mounting and installation and can require a less skill to implement. Accordingly, the method can provide flexibility of design and ensure accuracy in the installation of such design.

Figure 1:
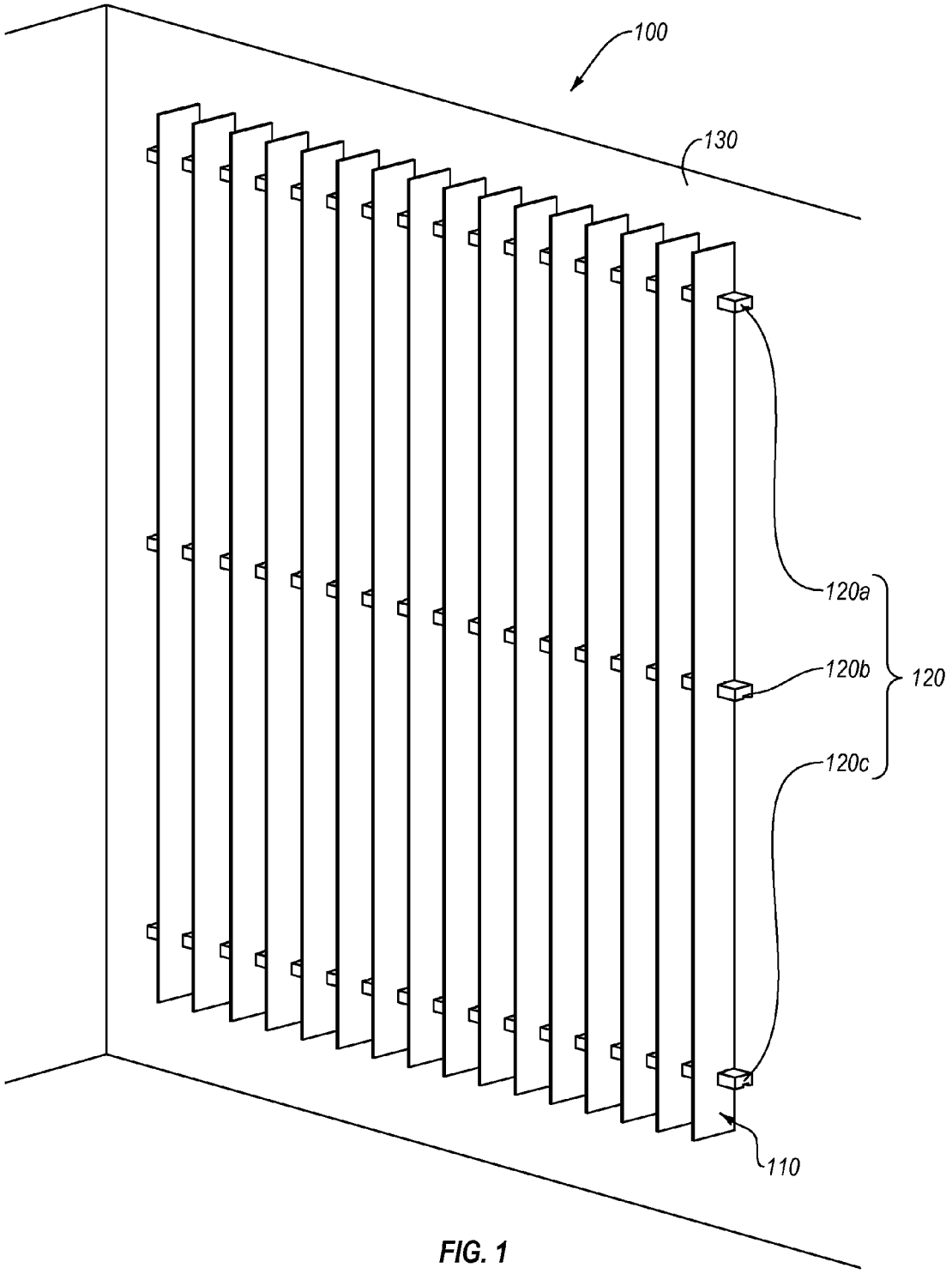
FIG. 1 illustrates a perspective view of a decorative multi-slat system in accordance with one implementation of the present invention.

An exemplary decorative multi-slat system is illustrated in FIG. 1. Particularly, FIG. 1 illustrates a decorative multi-slat system 100 that includes multiple rectangular decorative slats or panels 110. The decorative multi-slat system 100 also includes support rails 120 (e.g., support rails 120*a*, support rail 120*b*, and support rail 120*c*) that secure one or more decorative slats 110. It should be appreciated that, as further described below, the decorative multi-slat system 100 can include any number of decorative slats 110, which can have any suitable shape, configuration, color, size, and combinations thereof. Moreover, the decorative slats can form various patterns and can have various orientations relative to each other and/or relative to surrounding elements or components.

In one instance, the installer can secure the support rails 120 to a support surface 130, as further described below. For example, the decorative slats 110 can have a predetermined spacing one from another, which the designer or manufacturer can determine and preset or fix prior to installation. In other words, the manufacturer can supply an installation kit that has limited possible installation configurations of the decorative multi-slat system 100 (e.g., by limiting possible installations positions of the decorative slats 110). Presetting or predefining positions of the decorative slats 110 can reduce or eliminate errors, such as misalignment and incorrect spacing of the decorative slats 110, which can otherwise occur during the installation or mounting of the decorative multi-slat system 100.

As noted above, the decorative multi-slat system 100 can incorporate various and variously sized decorative slats 110, which can allow for a wide variety of different configurations and styles. Similarly, the decorative multi-slat system 100 also can incorporate a single support rail 120 or multiple support rails 120. For example, the designer may choose the number of support rails based on aesthetic considerations for a particular space, structural considerations for supporting the decorative slats 110 and/or the support surface 130, as well as a combination thereof.

In a number of implementations, the support rails 120 can support and secure the decorative slats 110 in a substantially vertical orientation, as illustrated in FIG. 1. Additionally or alternatively, the support rails 120 can secure the decorative slats 110 in other orientations, such as angled or horizontal. It should be appreciated that the support rail 120 can secure the decorative slats 110 at any desired angle relative to any surface or relative to a reference surface. For instance, the decorative slats 110 and/or the support rail 120 can have a desired orientation relative to the support surface 130.

Implementations of the present invention can allow the designer to choose to secure the support rails 120 to a vertical support surface 130 (e.g., a wall), to a horizontal support surface (e.g., ceiling, floor, roof, etc.), or to an angled or tilted support surface. Moreover, the designer can orient at least a portion of the decorative slats 110 and/or the support rail 120 to be substantially parallel with such support surface 130.

Additionally, the support rails 120 can couple to the support surface 130 at any number of angles with respect to one or more edges of the support surface 130. In one example, the designer or installer can orient the support rails 120 to be substantially parallel with a bottom edge of a vertical 130, such as a wall (e.g., the support rails 120 can be substantially parallel with a floor abutting the vertical wall). In additional or alternative examples, the support rails 120 can couple to the vertical support surface 130 at a 45° with respect to a bottom edge of thereof—i.e., at a 45° angle relative to the floor that abuts the vertical wall.

In at least one implementation, the support rails 120 can secure the decorative slats 110 such that the decorative slats 110 substantially maintain their original shape. In other words, connection points between the support rails 120 and the decorative slats 110 can coincide with an original geometry of the decorative slats 110. Thus, for instance, the installer can secure substantially flat decorative slats 110 to the support rails 120 in a manner that the decorative multi-slat system 100 has substantially flat (or straight) decorative slats 110, as illustrated in FIG. 1.

Alternatively, the installer can secure the decorative slats 110 to the support rails 120 in a manner that bends, deforms, or otherwise changes the shape of the decorative slats 110. In particular, one or more of the connection points of the decorative slats 110 with the support rails 120 may not coincide with the original geometry of the decorative slats 110. For instance, the installer may secure a flat decorative slat 110 at three connection points; two of such connection points may be in-line and one connection point may be offset. Accordingly, after connecting to the support rails 120, the decorative slats 110 can bend and/or deform (plastically or elastically) to have at least partially arcuate or bent shape.

In one or more implementations, decorative slats 110 can have specific connection points, at which the decorative slats 110 can couple to the support rails 120. As noted above, such connection points can define orientation of the decorative slats 110 and whether connecting the decorative slats 110 to the support rail 120 will deform or bend the decorative slats 110. In one example, predetermined connection points (i.e., connection points fixed or preset by the manufacturer) also can allow the manufacturer to simplify installation of the decorative multi-slat system 100, such as by limiting the number of possible connections of the decorative slats 110 with the support rail 120. Hence, predetermined connection points can reduce or eliminate instances of incorrect installation of the decorative multi-slat system 100.

Figure 2A:
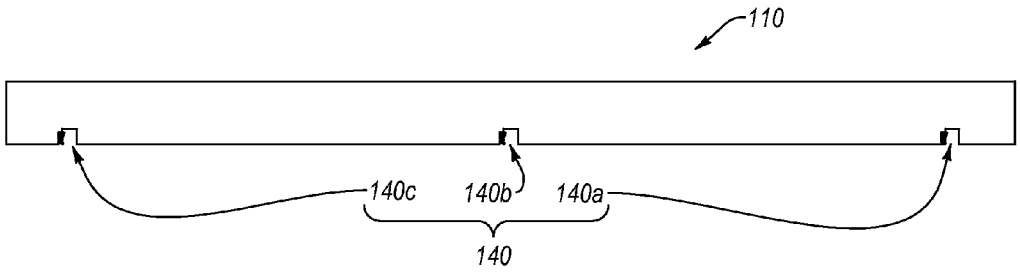
FIG. 2A illustrates a side view of a decorative slat in accordance with one implementation of the present invention.
Figure 2B:
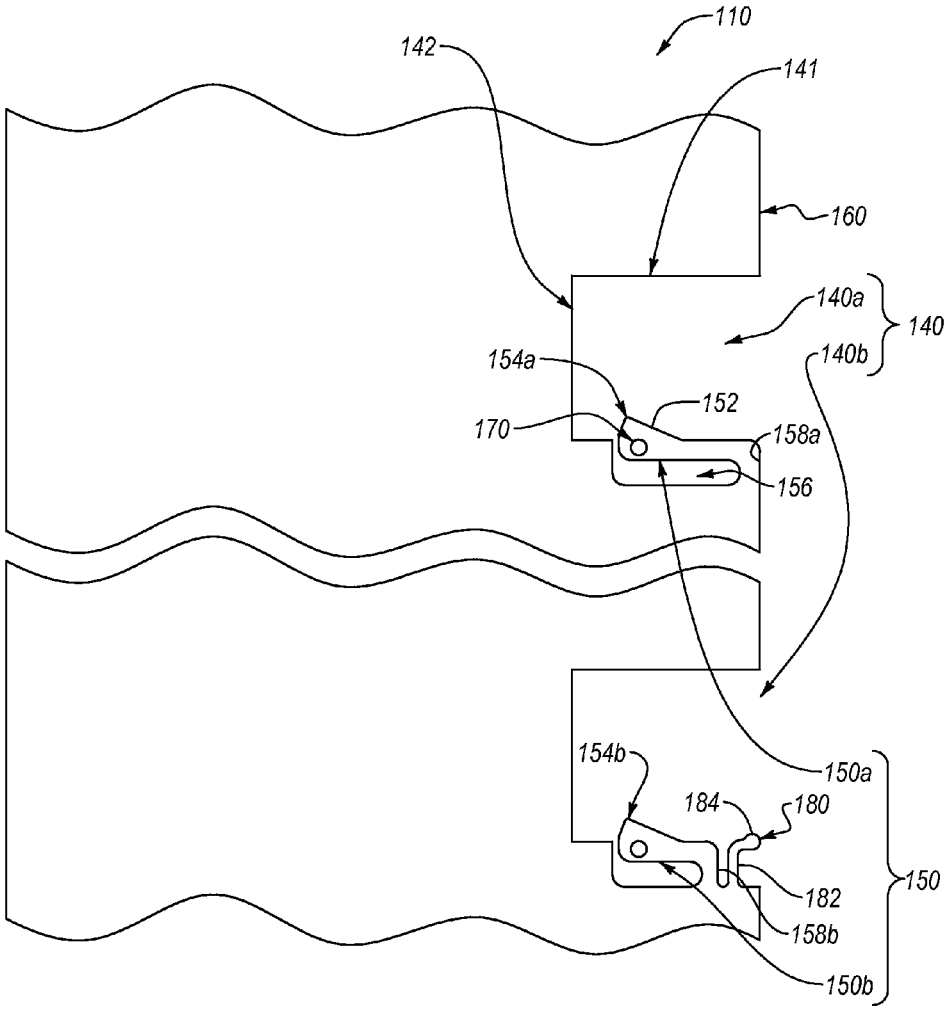
FIG. 2B illustrates an enlarged partial side view of the decorative slat of FIG. 2A.

FIGS. 2A and 2B illustrate on exemplary implementation of the decorative slat 110 as well as portions of the connection points located thereon. Specifically, FIGS. 2A and 2B illustrate the decorative slat 110 that comprises substantially rectangular sheet material. Such sheet material can have any suitable thickness, as may be desired by the designer or installer.

For example, the sheet material can be approximately ¼" thick. It should be noted that the sheet material can have any number of suitable shapes and outer dimension, which can correspond with the shape and outer dimension of the decorative slat 110 formed from such sheet. For instance, the sheet material can have a wave-like, an elliptical, or an irregular shape. Likewise, the sheet material (and the decorative slat 110) can have any number of profiles (e.g., flat, wavy, curving, bent).

In one or more implementations, the decorative slats 110 also can have a plurality of cutouts 140 (e.g., cutouts 140*a*, 140*b*, 140*c*). For instance, in the implementation illustrated in FIG. 2A, the decorative slat 110 has three cutouts 140*a*, 140*b*, 140*c*. It should be appreciated, however, that the decorative slat 110 can have any number of cutouts 140, which can vary from one implementation to the next, and which may depend, for instance, on the length, width, and rigidity of the decorative slat 110, among other factors.

Such cutouts 140 can have shape, size, and configuration that can fit about the support rails at a designated location. In at least one instance, the cutouts 140 can fit about the support rail in a manner that the decorative slat 110 is substantially immobilized relative to the support rail (i.e., such that the decorative slat 110 cannot move relative to the support rail). Thus, after coupling to the support rail, the decorative slat 110 can remain in a predetermined and substantially fixed position and/or orientation.

In one implementation, the cutouts 140 can fit over at least a portion of the support rails. Furthermore, the portions of the support rail that accepts the cutouts 140 can have a shape and size that form slip or loose fit within the cutouts 140. In other words, the cutouts 140 and the corresponding portions of the support rail can have sufficient clearance therebetween to allow the installer to couple the decorative slats 110 to the support rail. Accordingly, misalignment or imprecise placement of the support rail relative to the decorative slats 110 may not impede completing the installation of the decorative multi-slat system. Furthermore, increased clearance between the cutouts 140 and corresponding portions of the support rail can relax precision requirements for the cutouts 140 and/or for the corresponding portions of the support rails, which can reduce manufacturing cost.

In other implementations, the cutouts 140 can have an interference fit with the corresponding portions of the support rail. Such fit can help secure the decorative slats 110 to the support rails as well as to limit or prevent movement of the decorative slats 110 relative to the support rails. For instance, press-fitting the cutouts 140 of the decorative slats 110 onto the corresponding portions of the support rails can reduce movement and/or vibration of the decorative slats 110 that may otherwise occur (e.g., in response to air movement, such as wind or airflow inside a building). In any event, the cutouts 140 can at least in part secure the decorative slats 110 to the support rails.

The cutouts 140 also can orient and/or locate the decorative slats 110 relative to the support rails. As such, the cutouts 140 can orient the decorative slats 110 relative to the support surface as well as relative to other surrounding elements or components. For instance, the cutouts 140 can orient and/or secure the decorative slats 110 at a predetermined angle relative to the floor abutting the vertical support surface.

In at least one implementation, the cutouts 140 can have a substantially rectangular shape. Specifically, as illustrated in FIG. 2B, at least one of the cutouts 140 can have at least two substantially straight edges (e.g., top edge 141 and front edge 142) that form an approximately 90° angle therebetween. Such sides can orient and/or locate the cutout 140 with the corresponding portion of the support rail at a predetermined angle and/or in a predetermined location.

Nevertheless, it should be appreciated that the cutouts 140 can have any number of other suitable shapes, which can vary from one implementation to another. For instance, one or more of the cutouts 140 can have an arcuate shape that can fit over an arcuate shape of the corresponding portion of the support rail, thereby securing, locating, and/or orienting the decorative slats 110 with respect to the support rail. In any event, the cutouts 140 of the decorative slats 110 can fit over corresponding portions of the support rail at predetermined locations thereon.

Additionally or alternatively, the decorative slats 110 can incorporate other features and/or elements or components that can help to secure to the support rail. Hence, in at least one implementation, the decorative slats 110 can have connection elements, which can connect the decorative slats 110 to the support rails. In one example, connection elements of the decorative slats 110 are snap-in clips 150, which can secure the decorative slats 110 to the support rails. The snap-in clips 150 can be coupled to or incorporated with the decorative slats 110 (i.e., in a manner forming a monolithic and/or substantially unitary decorative slats 110 that include the snap-in clips 150).

The snap-in clips 150 can snap into a channel, a groove, a recess, or a similar cavity in the support rail that can accept and secure the snap-in clips 150 therein, as further described below. Moreover, in at least one implementation, the snap-in clips 150 can be configured in a manner that allows for removal of the snap-in clips 150 from the recess that accepts and secures the snap-in clips 150. Hence, the decorative slats 110 can be removable from the support rail without damaging the snap-in clips 150. Alternatively, the snap-in clips 150 can be configured in a manner that restricts removal of the decorative slats 110 from the support rail without damaging or breaking the snap-in clips 150.

The snap-in clips 150 can have a flexible, spring-like configuration that can allow the snap-in clips 150 to flex in response to applied force. Accordingly, the snap-in clips 150 can flex into the recess. The snap-in clip 150 also can have an angled portion 152, which can allow a corresponding portion of the support rail to deflect the snap-in clip 150 when the installer presses the corresponding portion of the support rail against the snap-in clip 150. In other words, as the installer presses the angled portion 152 against the corresponding portion of the support rail, the snap-in clip 150 can gradually flex as a contact point of the snap-in clip 150 with the support rail moves along the angled portion 152. Consequently, the snap-in clip 150 can reach a fully-flexed position, which can allow the installer to press the corresponding portion of the support rail past an uppermost point of the snap-in clip 150 (e.g., apexes 154*a*, 154*b* of the respective snap-in clips 150*a*, 150*b*).

As mentioned above, the snap-in clips 150 can be integrated with the decorative slats 110. Specifically, the decorative slats 110 can have a slot 156 that can form or define a lower edge of the snap-in clips 150. Furthermore, in at least one implementation, one or more of the cutouts 140 can have a single snap-in clip 150 located therein and/or proximally thereto. For instance, the upper edge as well as the angled portion 152 of the snap-in clips 150 can protrude into the opening formed by the cutouts 140. Thus, the snap-in clips 150 can flex away from the opening formed by the cutouts 140 as the decorative slat 110 presses against the support rails, which can allow the corresponding portion of the support rail to enter the cutouts 140. Thereafter, the snap-in clips 150 can flex back into or toward the openings formed by the cutouts 140, thereby entering the recesses in the support rails and coupling the decorative slats 110 to the support rails.

Although in the illustrated implementation each of the cutouts 140 accommodates a single snap-in clip 150, it should be appreciated that this invention is not so limited. More specifically, the cutouts 140 can have any number of snap-in clips 150 that can at least in part couple the decorative slat 110 to the support rail. Furthermore, multiple snap-in clips 150 can have any number of orientations and locations relative to each other as well as relative to the cutouts 140, which can vary from one implementation to another. For example, a first snap-in clip can be opposite to a second snap-in clip (e.g., the first snap-in clip positioned on or near a bottom edge of the cutout 140 and a second snap-in clip positioned near the top edge 141 of the cutout 140).

Also, the snap-in clips 150 can have any number of suitable configurations, shapes, sizes, and combinations thereof. For example, a back edge of the snap-in clip 150 can coincide with a back edge 160 of the decorative slats 110 (e.g., a back edge 158*a* of the snap-in clip 150*b*). Alternatively, the back edge of the snap-in clip 150 can be spaced apart from the back edge 160 (e.g., the back edge 158*b* of the snap-in clip 150*b*).

It should be also appreciated that, in at least one implementation, the back edge 160 of the decorative slat 110 can be substantially straight. In additional or alternative implementations, however, the back edge 160 can have any desirable contour (e.g., arcuate or irregular shaped). Moreover, the back edge 160 can have any suitable orientation relative to other edges of the decorative slats 110, as further described below. Thus, the back edge of the snap-in clip 150 also can conform with the any particular back edge 160 of the decorative slat 110.

As described above, the decorative slats 110 can incorporate multiple cutouts 140, such as the cutouts 140*a*, 140*b*, etc., each of which can include one or more snap-in clips 150 located in the proximity thereof. For example, the cutout 140*a* can include the snap-in clip 150*a* and the cutout 140*b* can include the snap-in clip 150*b* located in the respective proximities thereof. In one or more implementations, respective apexes 154*a*, 154*b* of the snap-in clips 150*a*, 150*b* can align with one another. Hence, for instance, location of the recesses, which can accept the snap-in clips 150*a*, 150*b*, on the various support rails can be substantially the same. As such, the support rails of the decorative multi-slat system can be interchangeable with each other, which can reduce manufacturing costs and/or eliminate or reduce installation errors.

In at least one implementation, the snap-in clips 150 can have an opening, a hole, and/or a perforation 170. Hence, the installer can insert a tool into the perforation 170 to press the snap-in clip 150 toward and/or into the fully-flexed position or configuration. Pressing the snap-in clips 150 toward the fully-flexed position can allow the installer to withdraw the snap-in clips 150 from the corresponding recesses in the support rail. Subsequently, the installer can decouple the decorative slat 110 from the support rails. It should be noted that the snap-in clips 150 can remain undamaged after decoupling of the decorative slats 110 from the support rails. Thus, the installer can re-couple the decorative slats 110 to a different set of support rails and/or to the same support rails at different connection points or at a different location.

In at least one implementation, the decorative slats 110 have one or more centering elements or springs 180. The centering elements 180 can be integrated with or coupled to the decorative slats 110. In one or more exemplary implementations, the decorative slat 110 can have fewer centering elements 180 than cutout 140. For instance, the decorative slats 110 can have three cutouts 140 and two centering elements 180.

In particular, the decorative slats 110 can have an uppermost connection point (e.g., the cutout 140*a* and the snap-in clip 150*a*) that does not include the centering element 180. Additionally or alternatively, other connection points may or may not have centering elements 180, as determined by the manufacturer. In light of this disclosure, those skilled in the art should appreciate that the manufacturer can choose the desired number and locations of the centering elements 180 based on the shape, dimension, material, and design/aesthetic requirements of the decorative slats 110 as well as the decorative multi-slat system 100.

Furthermore, centering elements 180 can have any number of shapes, sizes, and configurations that can vary from one implementation to another. For example, the centering element 180 can have an elongated portion 182, which can protrude toward and/or into the cutouts 140. The elongated portion 182 of the centering element 180 can be coupled to or integrated with the decorative slats 110.

In at least one implementation, the decorative slats 110 can have the elongated portion 182 located near the back edge 160 thereof. For instance, the centering element 180 can have the elongated portion 182 located between a back edge of the snap-in clip 150 and the back edge 160 of the decorative slat 110. In other words, the elongated portion 182 can have gaps or spaces between the back edge of the snap-in clip 150 and the back edge 160 of the decorative slat 110. Furthermore, the elongated portion 182 of the centering element 180 can be flexible and/or can have spring-like characteristics (i.e., the installer can elastically deform the elongated 182, which can subsequently return to its original configuration). Thus, the elongated portion 182 can bend or flex into the gaps between the snap-in clip 150 and/or the back edge 160 of the decorative slat 110.

Additionally, the centering element 180 can include an angled head 184. The angled head 184 can be integrated with or coupled to the elongated portion 182 of the centering element 180. Together, the elongated portion 182 and the angled head 184 can form an L-shaped centering element 180. When the installer secures the decorative slat 110 to the support rail, the angled head 184 can press against the support rail, thereby centering the decorative slats 110 relative to the support rail, as further described below.

Figure 3A:
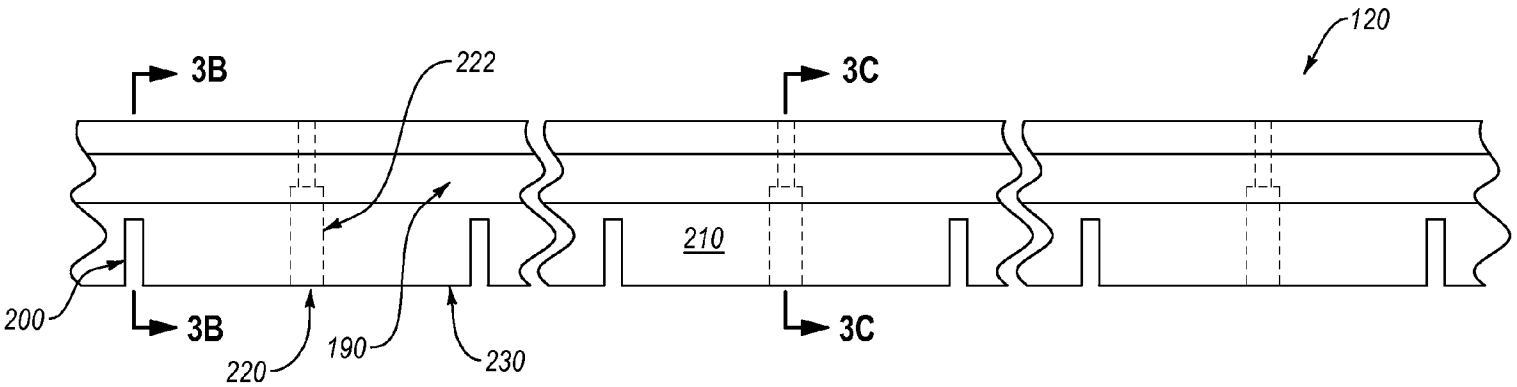
FIG. 3A illustrates a bottom view of a support rail in accordance with one implementation of the present invention.
Figure 3C:
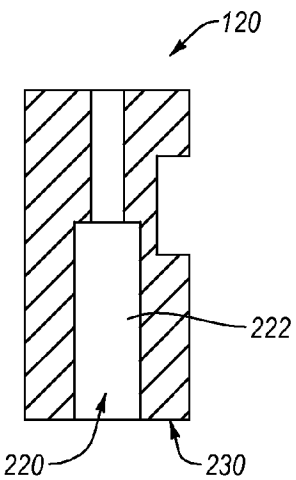
Figure 3B:
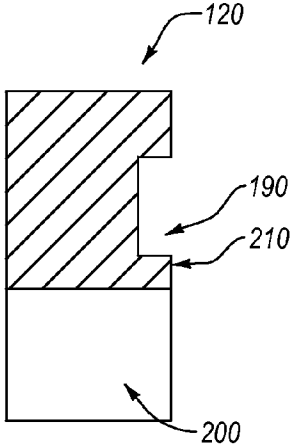
FIG. 3B illustrates a cross-sectional view of the support rail of FIG. 3A taken along the line 3B-3B of FIG. 3A.

As described above, the snap-in clip 150 can fit into a recess or channel in the support rails and can secure the decorative slats 110 to the support rails. For example, as illustrated in FIGS. 3A-3C, the support rail 120 can include a snap-in channel 190. The snap-in clip of the decorative slat can snap into the snap-in channel 190, thereby coupling or securing the decorative slat to the support rail 120, as described below in more detail.

The snap-in channel 190 can run through the entire support rail 120 or can have interruptions. Additionally or alternatively, the snap-in channel 190 can have various shapes, which can accommodate snap-in clips of multiple decorative panels therein. For example, the snap-in channel 190 can have a substantially rectangular shape. Accordingly, the snap-in clips can have a corresponding shape, such that the snap-in clips can flex out of the fully-flexed position and at least partially fit into the rectangular shape of the snap-in channel 190.

It should be appreciated that the particular shape and size of the snap-in channel 190 can vary from one implementation to the next. For instance, the shape and size may depend on the shape, size, and configuration of the snap-in clips. In any event, however, the snap-in channel 190 can have a suitable configuration to accept and secure the snap-in clips therein.

The support rails 120 also can have a plurality of slits 200 that can accept the decorative slats. The slits 200 can locate and position the decorative slats at desired and predetermined positions and/or orientations along the support rails 120. Accordingly, the builder can reduce the possibility of an installation error, which may result in an inaccurate presentation of the design of the decorative multi-slat system.

In at least one implementation, the slits 200 can be substantially perpendicular to a bottom surface 210 of the support rail 120. Consequently, when coupled to the support rail 120, the decorative slats also can be substantially perpendicular to the bottom surface 210 of the support rail 120. Thus, for example, the installer can couple the support rail 120 to a vertical supper surface in a manner that the support rail 120 and/or the bottom surface 210 thereof is substantially parallel with the bottom edge of the vertical support surface (e.g., parallel with the floor abutting the support surface). As such, the installer can then easily couple the decorative slats to the support rail 120, such that the decorative slats can be substantially perpendicular to the floor.

In other implementations, however, the slits 200 can form any suitable angle with the bottom surface 210 of the support rail 120 as well as with any other portion of the support rail 120. Furthermore, the support rail 120 can include slits 200 positioned at the same or at various angles relative to one another. In one example, all of the slits 200 can be substantially parallel to each other. In other examples, slits 200 can form other angles relative to each other. Moreover, angles between various slits 200 can vary from one pair of adjacent slits 200 to another pair of adjacent slits 200.

Additionally or alternatively, the slits 200 can have widths that are substantially the same (i.e., with minimum clearance) as thicknesses of the decorative slats. Such width can be the same for all of the slits 200 or can vary depending on the particular decorative slats that the builder intends for the corresponding slit 200. Thus, the decorative multi-slat system 100 can have a configuration that would permit installation of particular decorative slats 110 only within designated slits 200.

Likewise, the slits 200 can have a shape that corresponds with the shape of the portion of the particular decorative slat that fits within the slit 200. For instance, the slits 200 can be approximately rectangular. In other implementations, the slits 200 can have any suitable shape, such that the decorative slat can have a desired fit within such slit 200.

As described above, the installer can secure the support rails 120 to the support surface. For example, the support rails 120 can include mounting holes 220 that can accommodate such installation. The installer can insert mounting members (e.g., bolts, screws, rivets, etc.) through the mounting holes 220 and can secure the support rails 120 to the support surface 130.

In at least one implementation, the mounting holes can include a counterbore 222, which can accommodate a head of the mounting member. Accordingly, the installer can submerge or recess the head of the mounting member below a front surface 230 of the support rail 120. Moreover, the installer can insert a plug into the counterbore 222, to conceal the mounting member from the viewers of the decorative multi-slat system.

It should be appreciated that the installer can secure support rails 120 to the support surface using other fastening elements. For instance, the installer can use an adhesive (e.g., glue, epoxy, etc.) to secure the support rails 120 to the support surface. Moreover, the installer can suspend or hang the support rails 120 (e.g., using hang wires). For example, the installer can secure the support rails 120 with a hang wires to one or more horizontal support surfaces, such as a ceiling and a floor.

Figure 4:
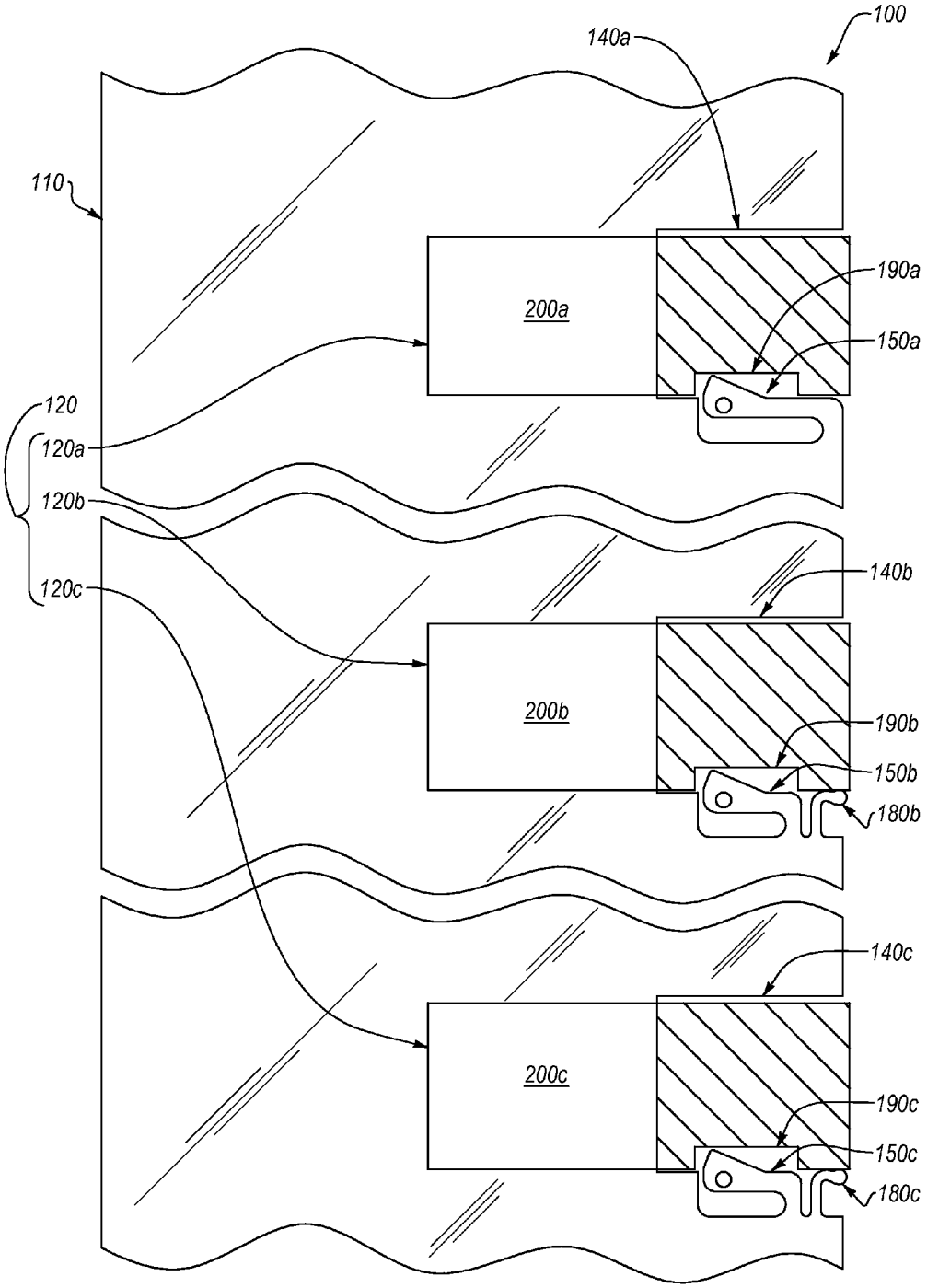
FIG. 4 illustrates a cross-sectional view of a decorative multi-slat system in accordance with one implementation of the present invention.

As described above, the snap-in clip can snap into the snap-in channel 190 of the support rails 120. FIG. 4 illustrates a cross-sectional view of the decorative multi-slat system 100 and shows the decorative slat 110 secured to the support rails 120. Specifically, FIG. 4 illustrates a transparent decorative slat 110. As such, the view illustrated in FIG. 4 shows cross-sectioned support rails 120, visible through the transparent decorative slat 110. It should be appreciated, however, that any one of the decorative slats 110 can have any number desirable optical and/or structural characteristics (e.g., transparency, translucency, opaqueness, color, flexibility, strength, etc.).

The installer can position and press the decorative slat 110 into slits 200*a*, 200*b*, 200*c* of the support rails 120*a*, 120*b*, 120*c*. As the installer further presses the decorative slat 110 into the support rails 120*a*, 120*b*, 120*c*, the cutouts 140*a*, 140*b*, 140*c* can fit around or about the support rails 120*a*, 120*b*, 120*c*. Accordingly, as mentioned above, the cutouts 140*a*, 140*b*, 140*c* can at least in part define the position and/or orientation of the decorative slats 110 relative to the support rails 120*a*, 120*b*, 120*c*.

Additionally, as the installer presses the decorative slat 110 into the slits 200*a*, 200*b*, 200*c*, the snap-in clips 150*a*, 150, 150*c* can flex into the fully-flexed configuration. When the installer presses the decorative slats 110 still further into the support rails 120*a*, 120*b*, 120*c*, the snap-in clips 150*a*, 150, 150*c* can flex out of the fully-flexed position and into snap-in channels 190*a*, 190*b*, 190*c* of corresponding support rails 120*a*, 120*b*, 120*c*, thereby securing the decorative slat 110 to the support rails 120*a*, 120*b*, 120*c*.

As noted above, the clips snap-in clips 150*a* 150, 150*c* can comprise spring-like material, which can allow the clips snap-in clips 150*a*, 150, 150*c* to flex and return substantially to original configuration after flexing. For example, the snap-in clips 150*a*, 150, 150*c* can comprise a suitable thermoplastic material. In particular, as mentioned above, the manufacturer can integrate the snap-in clips 150*a*, 150, 150*c* into the decorative slat 110, which, in turn, can comprise a suitable thermoplastic material, such as polycarbonate.

Centering elements 180*a*, 180*b* can provide support, guidance, and centering for the decorative slat 110, such that the cutouts 140*a*, 140*b*, 140*c* properly fit over respective support rails 120*a*, 120*b*, 120*c*. In other words, the centering elements 180*a*, 180*b* can set the cutouts 140*a*, 140*b*, 140*c* at a predetermined position relative to the respective support rails 120*a*, 120*b*, 120*c* (e.g., such that top edges of the cutouts 140*a*, 140*b*, 140*c* rest against the top surface the support rails 120*a*, 120*b*, 120*c*).

It should noted that FIG. 4 shows a gap between the top edges of the cutouts 140*a*, 140*b*, 140*c* and the respective top surfaces of the support rails 120*a*, 120*b*, 120*c* for illustrative purposes only. Specifically, as described above, the top edges of the cutouts 140*a*, 140*b*, 140*c* can abut or press against the top surfaces of the support rails 120*a*, 120*b*, 120*c*. Nevertheless, in at least one implementation, the decorative multi-slat system 100 can have a gap between support rails 120 and the top edge of the cutouts 140*a*, 140*b*, 140*c*.

Additionally, the cutouts 140*a*, cutouts 140*b*, cutouts 140*c* can include clearances with respect to the corresponding portions of the support rails 120 (i.e., the cutouts 140*a*, cutouts 140*b*, cutouts 140*c* can be bigger than the corresponding portions of the support rails 120). Thus, centering elements 180*b*, 180*c* can allow the installer to position and locate the decorative slat 110 at predetermined position with respect to the top surfaces of the support rails 120*a*, 120*b*, 120*c*. Locating and/or centering of the decorative slats 110 with respect to the support rails 120 with the centering elements 180*a*, 180*b* can ensure accurate positioning of the decorative slats 110 within the decorative multi-slat system 100.

Furthermore, the centering elements 180*a*, 180*b* can allow the manufacturer to provide additional clearance in any of the cutouts 140*a*, 140*b*, 140*c*, which can reduce time and/or complexity of the decorative multi-slat system 100 installation. More specifically, the centering elements 180*a*, 180*b* can have spring-like properties, as described above, and can force the top edges of the cutouts 140*a*, 140, 140*c* against the top surface of the support rails 120. Accordingly, the centering elements 180*a*, 180*b* can position the decorative slats 110 in a predetermined location (defined by one or more edges of the cutouts 140*a*, 140*b*, 140*c*) irrespective of the clearance between the cutouts 140*a*, 140*b*, 140*c* and the corresponding support rails 120.

In one or more implementations, the uppermost cutout 140*a* of a given slat decorative slat 110 may not include a centering element, while the cutouts 140*b*, 140*c* may have respective centering elements 180*b*, 180*c*. This can allow the installer to decorative slat 110 as a guide for positioning the support rails, as described below in greater detail.

As described above, the centering elements 180 can have an L-shaped form. The angled head of the centering element 180 can allow the centering element 180 to flex gradually, as the installer presses the decorative slat 110 into the support rail 120. FIG. 4 illustrates the centering element 180 flexed into a fully-flexed configuration. When in the fully-flexed configuration, the centering elements 180 can continuously apply force onto the support rails 120, pressing the top edges of the cutout cutouts 140 against the top surface of the support rails 120*s*.

Similar to the snap-in clips 150, the centering elements 180 can comprise a suitable thermoplastic material, which can allow the centering elements 180 to flex and remain in the flexed position while applying force onto the support rails 120. For example, the centering elements 180 can comprise polycarbonate, PETG, PMMA, thermoplastic or other suitable thermoplastic materials. In any event, the elongated portions and/or the angled heads of the centering elements 180 can flex in a manner that allows the centering element s180 to press against the support rails 120.

In light of this disclosure, those skilled in the art should appreciate that this invention is not limited to L-shaped centering elements 180. For example, the centering elements 180 can comprise a post and a spring (e.g., a coil compression spring) that can sit on the post, and which can press against the support rail 120. Additionally or alternatively, the support rail 120 can incorporate centering elements on or near the bottom surface thereof. Such centering elements can press against the decorative slats 110 in a manner that presses the top edges of the cutouts 140*a*, 140*b*, 140*c* against the top surface of the support rails 120*a*, 120*b*, 120*c*. In any event, the decorative multi-slat system 100 can include centering elements that can position the decorative slats 110 relative to the support rails 120 (e.g., by pressing the top edge of the cutouts 140 against the top surfaces of the support rails 120).

Figure 5A:
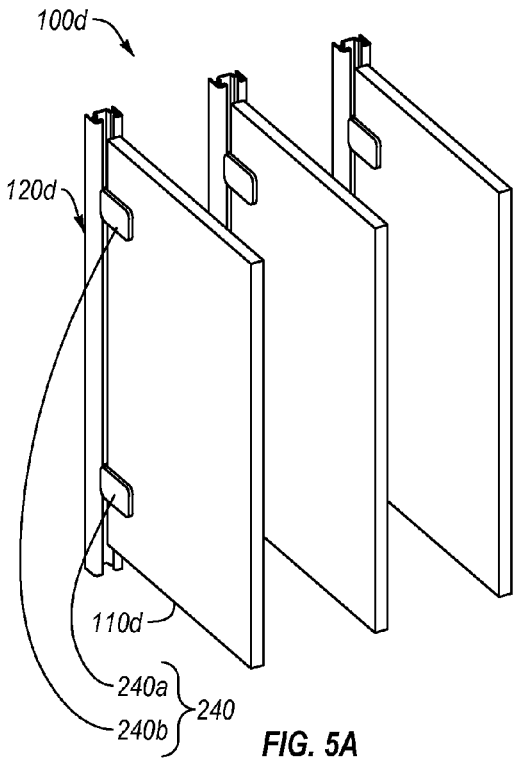
FIG. 5A illustrates a perspective view of a decorative multi-slat system in accordance with another implementation of the present invention.
Figure 5B:
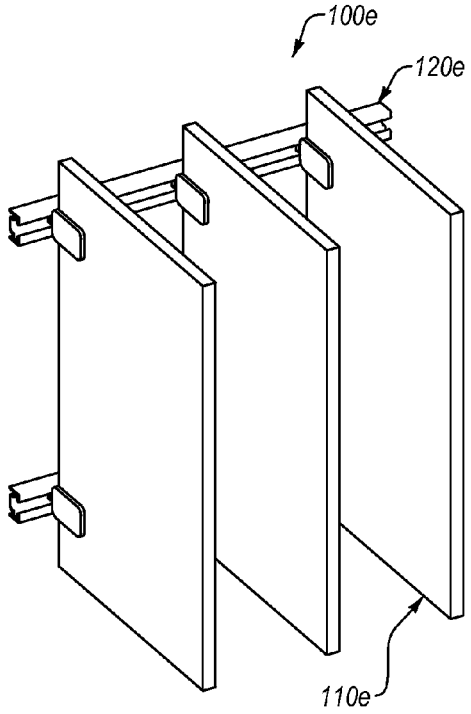
FIG. 5B illustrates a perspective view of a decorative multi-slat system in accordance with yet another implementation of the present invention.
Figure 5C:
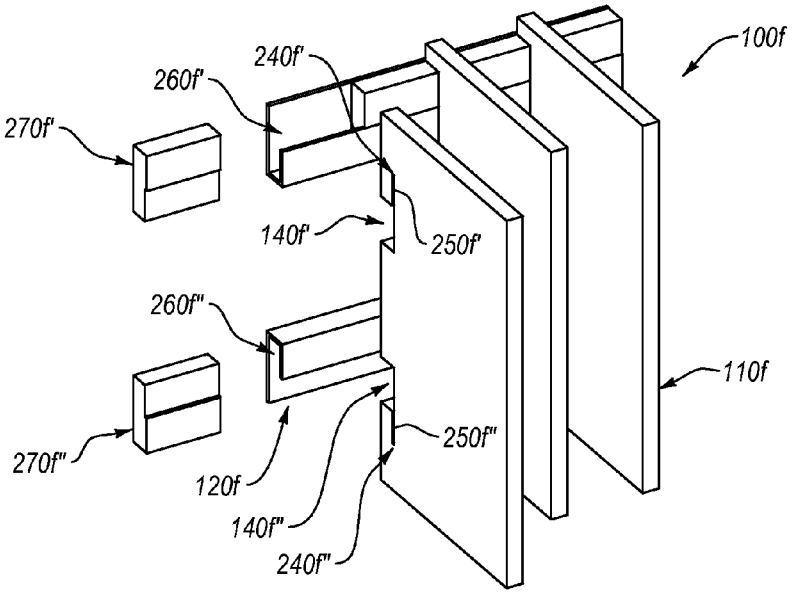
FIG. 5C illustrates a perspective view of a decorative multi-slat system in accordance with a further implementation of the present invention.

As described above, the support rails 120 can have various configurations for securing the decorative slats 110 in the decorative multi-slat system 100. For example, as illustrated in FIGS. 5A-5C, decorative multi-slat systems 100*d*, 100*e*, 100*f* can incorporate support rails 120*d*, 120*e*, 120*f* that have a track-like configuration. In one implementation, as illustrated in FIG. 5A, the decorative multi-slat system 100*d* can involve a single support rail 120*d* that can secure a single decorative slat 110*d*. Except as otherwise described herein, the decorative multi-slat system 100*d* and its components and/or elements can be similar to or the same as the decorative multi-slat system 100 (FIGS. 1-4).

Particularly, as shown by FIG. 5A, the support rail 120*d* can have a channel (e.g., a T-slot or T-shaped channel) that can accept mounting brackets 240 (such as mounting brackets 240*a*, 240*b*). In turn, the mounting brackets 240 can couple to the decorative slats 110*d*. For example, the mounting brackets 240 can have a channel formed by opposing plates; such channel can accept and secure the decorative slats 110*d* therein. Thus, the mounting brackets 240 can couple the decorative slats 110*d* to the support rail 120*d*.

Furthermore, the installer can secure the support rail 120*d* to the support surface at any location and in any orientation. Similarly, the installer can secure the decorative slats 110*d* at any location or position along a length of the support rail 120*d*. The installer also can secure multiple support rails 120*d* that hold respective decorative slats 110*d*, which together can form the decorative multi-slat system 100*d*. Such decorative multi-slat system 100*d* can have any number of configurations and arrangements that can vary from one implementation to the next (e.g., spacing between the decorative slats 110*d*, orientation of the decorative slats 110*d*, etc.).

Alternatively, multiple support rails can secure one or more decorative slats. For example, FIG. 5B illustrates the decorative multi-slat system 100*e* that includes support rails 120*e*, which can secure decorative slats 110*e* at various locations and orientations. The decorative multi-slat system 100*e* and its components and/or elements can be similar to or the same as the decorative multi-slat system 100 and/or decorative multi-slat system 100*d* (FIGS. 1-5A) and their respective components and/or elements, except as otherwise described herein. In one or more implementations, the decorative slats 110*e* can have a substantially orthogonal orientation relative to the support rail 120*e*. Alternatively, the decorative slats 110*e* can have other angled orientation (e.g., the mounting brackets can off set such that decorative slat 110*e* forms a non-orthogonal angle with respect to the support rails 120*e*).

Moreover, in light of this disclosure, those skilled in the art should appreciate that the mounting bracket can slidably couple to the support rails 120*e*. As such, the installer can slide the mounting brackets along the support rails 120*e* into a desired position prior to, or after, securing the decorative slats 110*e* to the mounting brackets. Once located at the desired position, the installer can fix the mounting brackets to the support rails 120*e*. Additionally, the mounting brackets can allow the installer to selectively change or alter the installation by moving the decorative slats 110*e* along the support rail 120*e*.

As noted above, the decorative slats may incorporate mounting elements or connection elements, such as snap-in clips and/or centering elements. In at least one implementation, as illustrated in FIG. 5C, the decorative slats 110*f* can have integrated mounting elements 240*f*', 240*f*". The decorative multi-slat system 100*f* and all of its components and/or elements can be similar to or the same as any one of the decorative multi-slat systems 100, 100*d*, 100*e* (FIGS. 1-5B) and their respective components and/or elements, except as otherwise described herein.

For instance, the decorative slats 110*f* can include integrated mounting elements 240*f*', 240*f*" that comprise respective cutouts 140*f*', 140*f*' and slots 250*f*', 250'. As such, the integrated mounting elements 240*f*', 240*f*' can slide into and/or couple within respective channels 260*f*', 260*f*' of support rails 120*f*. Furthermore, the installer can arrange and/or position the decorative slats 110*f* relative to the support rails 120*f* in any number of ways.

In one example, the decorative multi-slat system 100*f* can include multiple decorative slats 110*f* arranged with predetermined spaces or gaps therebetween. For instance, the decorative multi-slat system 100*f* can incorporate spacer blocks 270*f*', 270*f*", which can fit into the respective channels 260*f*', 260*f*" of the support rails 120*f*. The spacer blocks 270*f*', 270*f*" can have a predetermined width that can define spacing between the decorative slats 110*f*. Specifically, the installer can position the spacer blocks 270*f*', 270*f*" between adjacent decorative slats 110*f* to provide a fixed and predetermined separation or gaps therebetween.

In one implementation, the spacer blocks 270*f*', 270*f*" can have substantially the same width. Thus, the adjacent decorative slats 110*f* can have a substantially parallel orientation relative to each other. Alternatively, however, the spacer block 270*f*' can be wider than the spacer block 270*f*" (or vice versa). Consequently, adjacent decorative slats 110*f* can have angled or non-parallel orientation relative to each other.

Figure 5D:
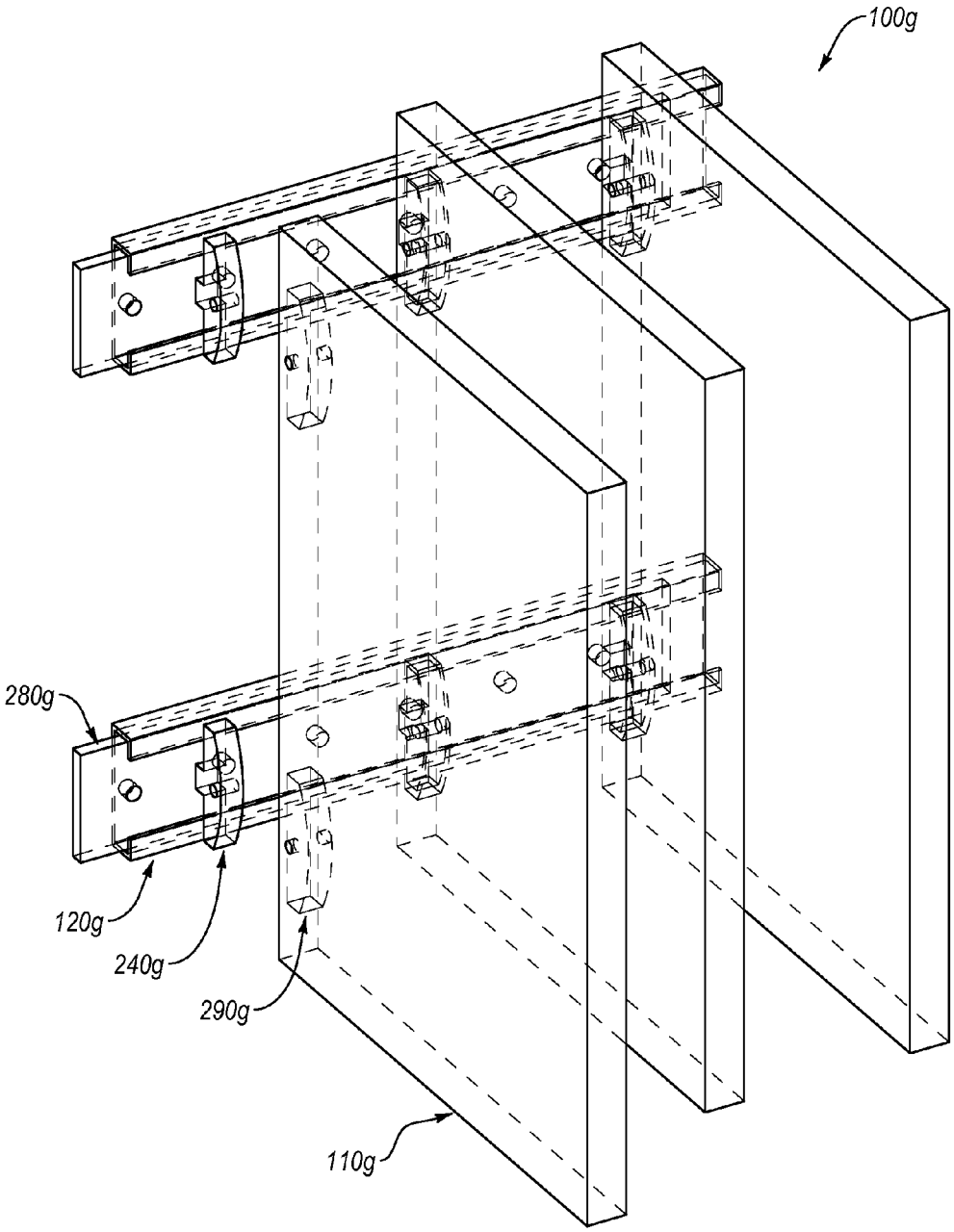
FIG. 5D illustrates a perspective view of a decorative multi-slat system in accordance with an additional implementation of the present invention.

In one or more instances, the installer can fix relative positions and orientations of the decorative slats before mounting the decorative slats on the support surface. For example, as illustrated in FIG. 5D, a decorative multi-slat system 100*g* can include decorative slats 110*g* that can mount to strips 280*g*. Except as otherwise described herein, the decorative multi-slat system 100*g* as well as all of the components and/or elements thereof can be similar to, or the same as, any one of the decorative multi-slat systems 100, 100*d*, 100*e*, 100*f* (FIGS. 1-5C) and their respective components and/or elements. In one or more implementations, mounting brackets 240*g* can couple the decorative slats 110*g* to the strips 280*g*.

For instance, the manufacturer can fabricate the strips 280*g* with predetermined mounting locations for the mounting brackets 240*g*. Accordingly, the installer can secure the decorative slats 110*g* to the strips 280*g* at such predetermined mounting locations. For example, the decorative slats 110*g* can have recesses 290*g* that can accept and secure mounting brackets 240*g*. In one implementation, a fastener can pass through the decorative slat 110*g* and through the mounting bracket 240*g* (located in the recess 290*g*), thereby securing the mounting bracket 240*g* to the decorative slat 110*g*.

Similarly, the installer can secure the mounting brackets 240*g* to the strips 280*g* with one or more fasteners. As noted above, the manufacturer can prefabricate the strips 280*g* that include predetermined locations (e.g., holes) for the fasteners. Accordingly, the mounting brackets 240*g* can couple the decorative slats 110*g* to the strips 280*g* at predetermined locations and at predetermined orientations relative to each other as well as relative to the strips 280*g*.

The strips 280*g*, in turn, can slide into and/or couple to support rail 120*g*. For instance, the support rails 120*g* can have T-slots that can secure the strips 280*g* to the support rails 120*g*. Additionally or alternatively, the installer can secure the strips 280*g* to the support rails 120*g* with fasteners. Moreover, the support rails 120*g* can have predetermined fastening locations, such that the strips 280*g* can couple to the support rails 120*g* at know or predetermined locations. As such, the manufacturer can limit the number of possible installation configurations, which can reduce potential errors during the installation of the decorative multi-slat system 100*g*. Also, as described above, the installer can mount or secure the support rails 120*g* to the support surface in any number of suitable ways.

In one or more implementations, as mentioned above, the support surface can be vertical (e.g., a wall of or in a building). This invention, however, is not so limited. The decorative multi-slat systems and/or components thereof can couple to support surfaces having any number of orientations or positions. Among other orientations, the support surfaces that, for example, secure the support rails can have horizontal orientation (e.g., a ceiling, a floor, etc.) or slanted orientation (e.g., a slanted wall or a slanted ceiling). Still further, the decorative multi-slat systems can extend along a ceiling and then turn down a wall.

Figure 6:
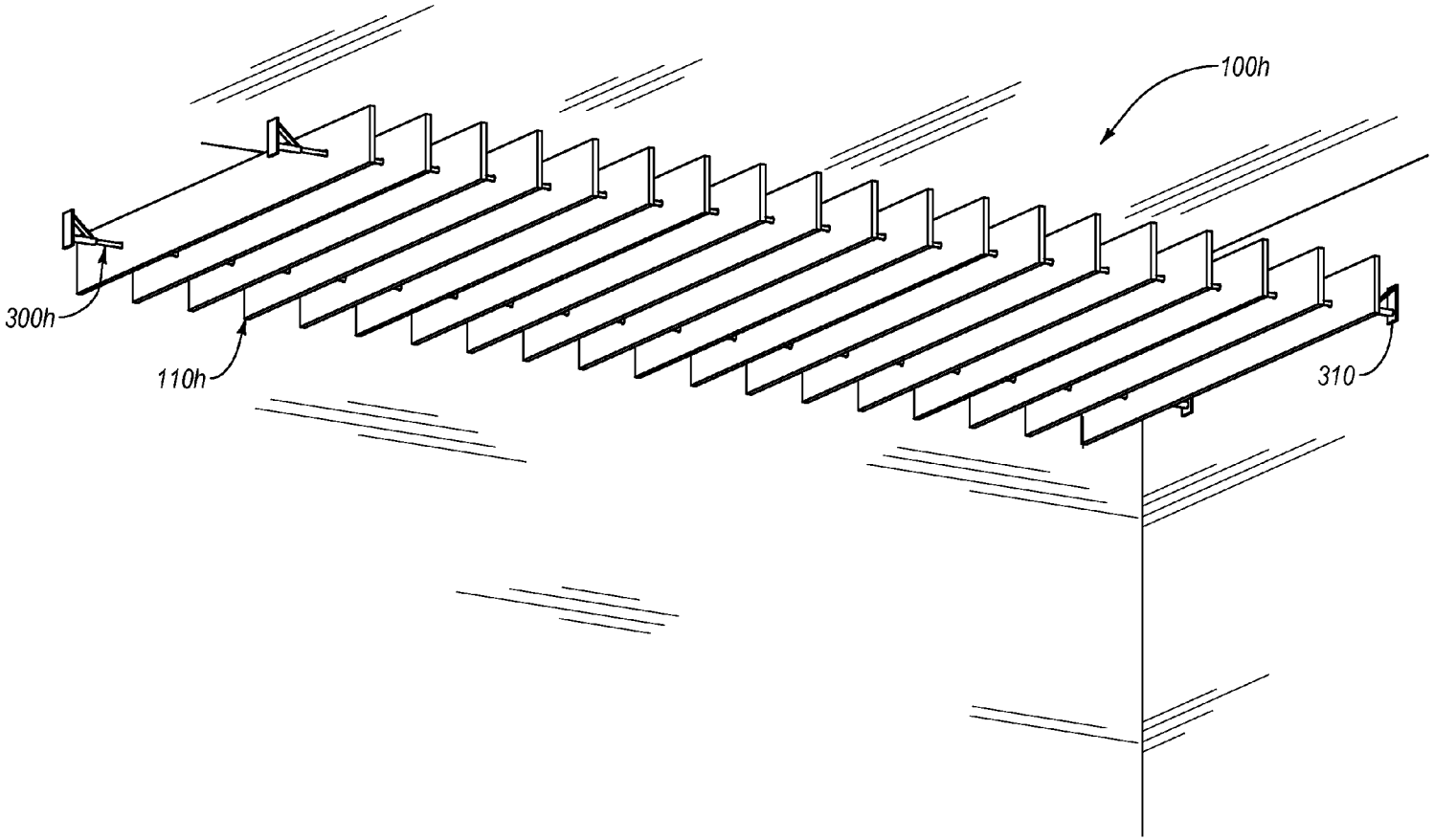
FIG. 6 illustrates a perspective view of a decorative multi-slat system in accordance with yet another implementation of the present invention.

Furthermore, implementations of the present invention can include decorative multi-slat systems without support rails. For instance, as illustrated in FIG. 6, a decorative multi-slat system 100*h* can incorporate hanging wires 300*h*, which can secure decorative multi-slat system 100*h* between opposing support surfaces. Except as otherwise described herein, the decorative multi-slat system 100*h* as well as all of the components and/or elements thereof can be similar to, or the same as, any one of the decorative multi-slat systems 100, 100*d*, 100*e*, 100*f*, 100*g* (FIGS. 1-5D) and their respective components and/or elements. Accordingly, the decorative slats 110*h* can couple to the hang wires 300*h* directly. As described above, in alternative implementations, the decorative slats 110*h* can couple to the hanging wires 300*h* through the support rails.

In at least one implementation, the installer can make perforations in the decorative slats 110*h* that can accommodate the hanging wires 300*h*. As such, the installer can position decorative multi-slat system 100*h* between two support surfaces, suspending the decorative slats 110*h* on the hanging wires 300*h*. For example, the hanging wires 300*h* can couple to posts 310*h* that, in turn, can couple to respective support surfaces. It should be appreciated that the posts 310*h* can couple to the support surfaces in a similar manner as the support rails, as described above.

Such support surfaces can be parallel to each other. It should be noted, however, that such support surfaces can have any suitable orientation relative to each other. In any event, the decorative multi-slat system 100*h* can have a vertical, horizontal, or angled orientation relative to the support surface and/or relative to any other reference surface.

Figure 7A:
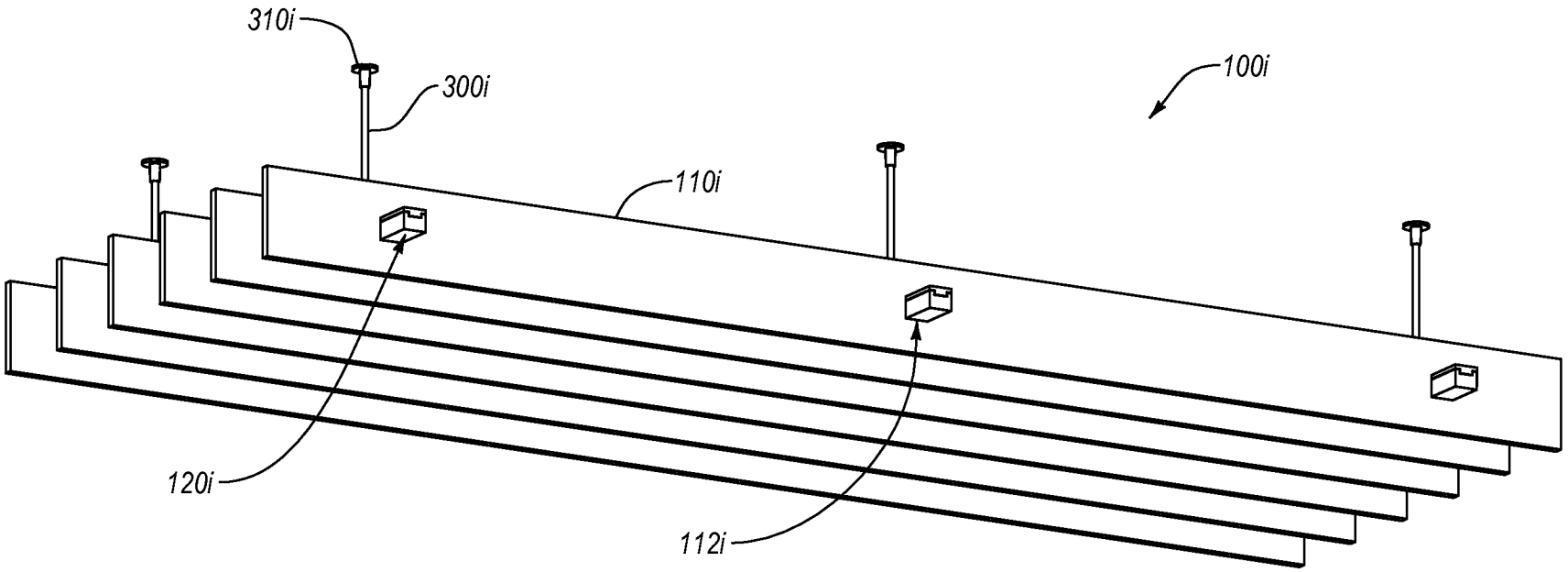
FIG. 7A illustrates a perspective view of a decorative multi-slat system in accordance with still one other implementation of the present invention.

As mentioned above, the hanging wires also can couple and/or support the support rails that secure decorative slats. For instance, as illustrated in FIG. 7A a decorative multi-slat system 100*i* can incorporate support rails 120*i* that secure decorative slats 110*i*. Except as otherwise described herein, the decorative multi-slat system 100*i* as well as all of the components and/or elements thereof can be similar to, or the same as, any one of the decorative multi-slat systems 100, 100*d*, 100*e*, 100*f*, 100*g*, 100*h* (FIGS. 1-6) and their respective components and/or elements.

In one implementation multiple hanging wires 300*i* can secure the support rails 120*i* to a support surface. Specifically, the hanging wires 300*i* can couple or connect to posts 310*i*, which can couple to a desired support surface. For instance, the installer can secure the decorative multi-slat system 100*i* to a horizontal support surface, such as a ceiling. Furthermore, in one or more implementations, the installer can orient the decorative slats 110*i* substantially parallel to the support surface. Alternatively, the installer can vary the length of the different hanging wires 300*i* so that the decorative multi-slat system 100*i* is orientated at an angle to the ceiling.

Implementation of the present invention also can include the decorative slats 110*i* that have cutouts or holes 112*i* passing therethrough, in a manner that creates perforations or holes in the decorative slats 110*i*. The support rails 120*i* can pass through the holes 112*i*, such that the installer can secure the support rails 120*i* within the holes 112*i*, as described in further detail bellow. Moreover, as further described below, the support rails 120*i* can allow the installer to secure the decorative slats 110*i* thereto at predetermined locations, which can reduce or eliminate installation errors.

Figure 7B:
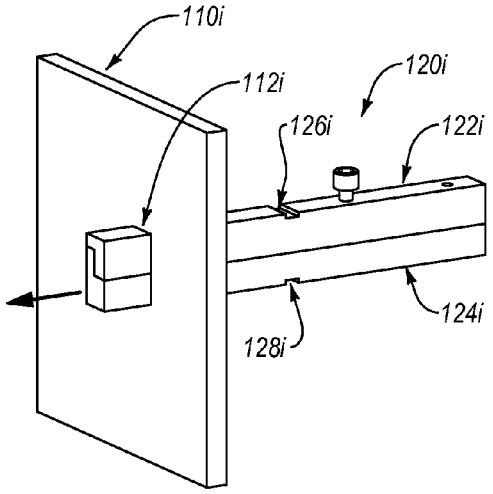
FIG. 7B illustrates a perspective cross-sectional view of an act in an installation procedure of the decorative multi-slat system of FIG. 7A in accordance with still one other implementation of the present invention.
Figure 7C:
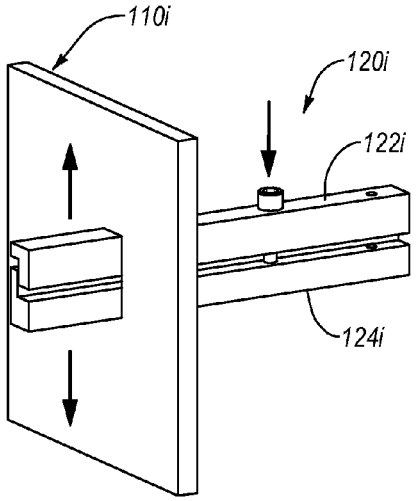
FIG. 7C illustrates a perspective cross-sectional view of another act in an installation procedure of the decorative multi-slat system of FIG. 7A in accordance with still one other implementation of the present invention.
Figure 7D:
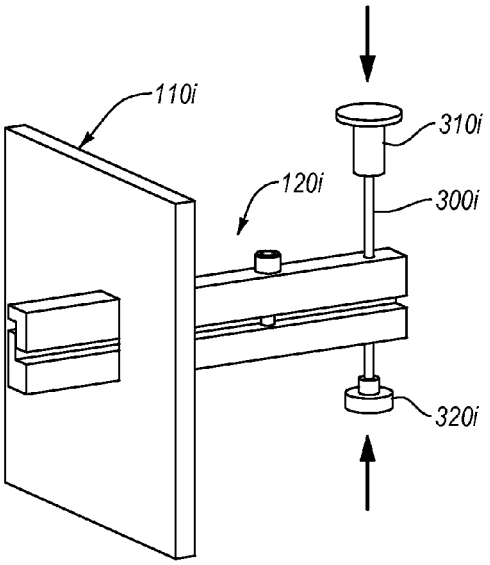
FIG. 7D illustrates a perspective cross-sectional view of yet one other act in an installation procedure of the decorative multi-slat system of FIG. 7A in accordance with still one other implementation of the present invention.

For example, as illustrated in FIGS. 7B-7D, the installer can insert the support rail 120*i* into the hole 112*i* and can, subsequently, secure the support rail 120*i* to the decorative slat 110*i*. In particular, as illustrated in FIG. 7B, the installer can insert a portion of the support rail 120*i* into the hole 112*i* of the decorative slat 110*i*. In at least one implementation, the support rail 120*i* can have first and second halves 122*i*, 124*i*. Specifically, the first and second halves 122*i*, 124*i* can fit together, such that the support rails 120*i* can fit into the holes 112*i*.

Moreover, the first and second halves 122*i*, 124*i* can have a sliding coupling, such that the installer can move the first and second halves 122*i*, 124*i* relative to each other, such as to increase the overall outside perimeter or cross-section of the support rail 120*i*. The first and second halves 122*i*, 124*i* also can have a guided movement, relative to each other. In other words, as the first and second halves 122*i*, 124*i* move away or toward each other, the movement can occur along a predetermined trajectory.

The support rail 120*i* also can include opposing slits 126*i*, 128*i* similar to the slit 200. In particular, portions of the decorative slat 110*i* that surround the holes 112*i* can fit into the opposing slits 126*i* 128*i*. For instance, as illustrated in FIG. 7C, the installer can move the first and second halves 122*i*, 124*i* of the support rail 120*i* away from each other, such that the opposing slits of the support rail 120*i* engage and couple to the decorative slat 110*i* within the hole 112*i*. Furthermore, the support rail 120*i* can have the opposing slits positioned at predetermined distances from one another. As such, the installer can couple the decorative slats 110*i* at predetermined distance and locations along the support rails 120*i*.

In one implementation, the support rail 120*i* can incorporate a separation mechanism, such as a fastener, which can push the first and second halves 122*i*, 124*i* away from each other. The first and/or second halves 122*i*, 124*i* can at least partially conceal the fastener, such that the fastener is at least partially not visible to the viewer of the decorative multi-slat system. Furthermore, the support rail 120*i* can include any number of suitable separation mechanisms, which can vary from one implementation to another. For instance, the support rail 120*i* can include wedges that can spread apart the first and second halves 122*i*, 124*i* to a desired separation therebetween.

As illustrated in FIG. 7D, The installer also can secure the hanging wires 300*i* to the support rails 120*i*, which can allow the installer to secure the decorative multi-slat system to the support surface. For instance, a stopper 320*i* can couple to the hanging wires 300*i* and can prevent movement of the hanging wires 300*i* relative to the support rails 120*i* in at least one direction. Additionally, the stopper 320*i* can fit inside of the support rails 120*i*, such that the support rails 120*i* at least partially conceals the stopper 320*i* therein. Also, as mentioned above, the hanging wires 300*i* can couple to the posts 310*i*, which can secure the decorative multi-slat system to the support surface.

As noted above, the decorative slats 110*i* can have a substantially parallel orientation relative to the support surface. It should be appreciated, however, that this invention is not so limited. Specifically, the decorative slats can have any number of orientations relative to the support surface. Furthermore, the support rail also can have numerous orientations within the decorative slat, such as to allow the installer to secure the decorative multi-slat system at essentially any desirable orientation and/or location relative to one or more support surfaces.

Figure 8:
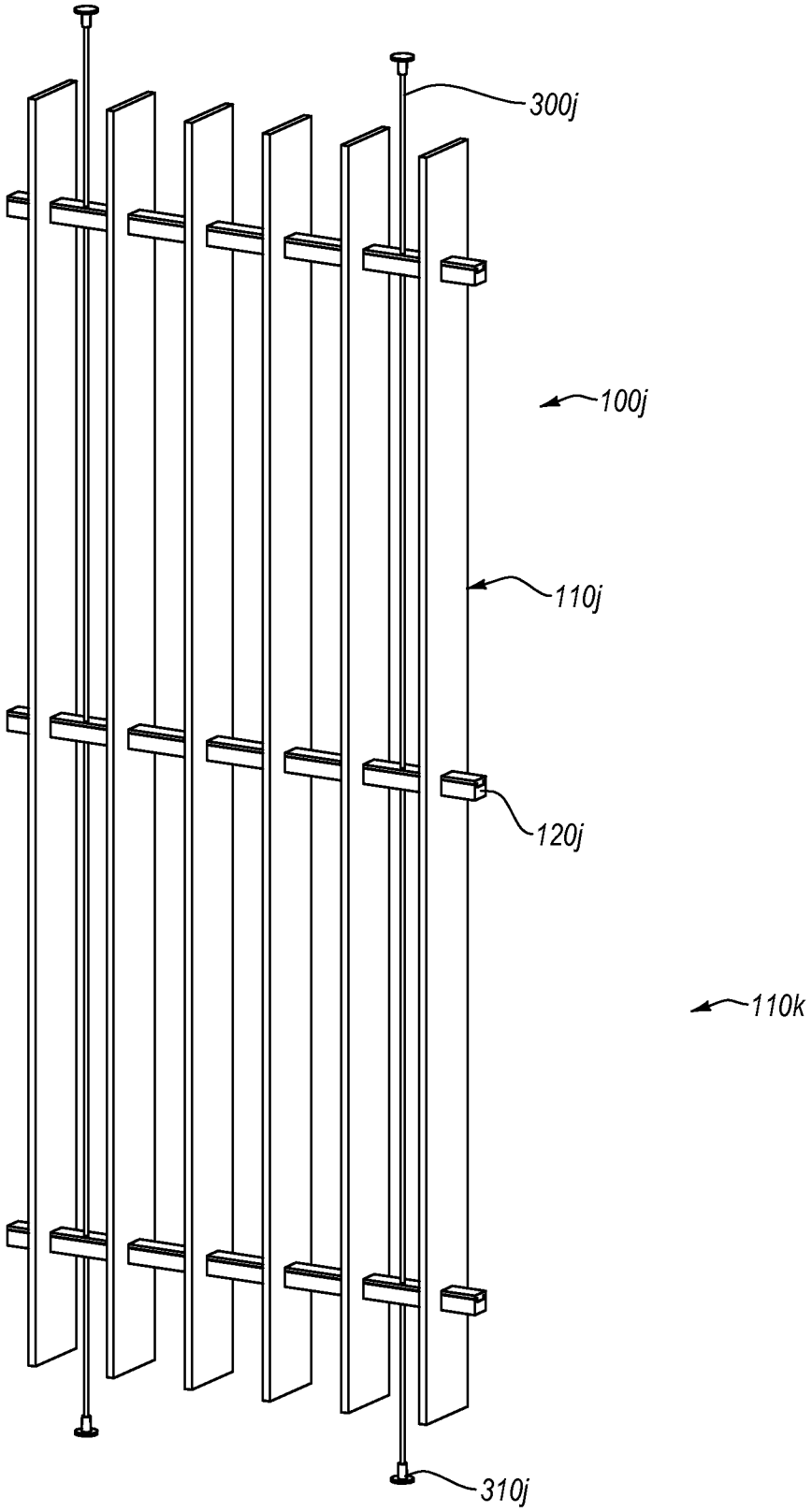
FIG. 8 illustrates a perspective view of a decorative multi-slat system in accordance with one or more implementations of the present invention.

For example, as illustrated in FIG. 8, a decorative multi-slat system 100*j* can couple to opposing support surfaces. Except as otherwise described herein, the decorative multi-slat system 100*j* as well as all of the components and/or elements thereof can be similar to, or the same as, any one of the decorative multi-slat systems 100, 100*d*, 100*e*, 100*f*, 100*g*, 100*h*, 100*i* (FIGS. 1-7A) and their respective components and/or elements. In particular, the hanging wires 300*j* can pass through and couple to the support rails 120*j*. Moreover, posts 310*j* can secure hanging wires 300*j* to the opposing support surfaces.

As such, the decorative multi-slat system 100*j* can include multiple decorative slats 110*j* secured to the support rails 120*j*, which can have a substantially orthogonal orientation relative to the opposing support surfaces (e.g., the decorative multi-slat system 100*j* can form a divider). Furthermore, as noted above, the decorative slats 110*j* and the support rails 120*j* can be the same as the decorative slats 110*i* and support rails 120*i* (FIG. 7A). In at least one implementation, however, the decorative slats 110*j* and the support rails 120*j* and have different relative orientation than the decorative slats 110*i* and support rails 120*i* (FIGS. 7B-7D). More specifically, the installer can orient the decorative slats 110*j* and the support rails 120*j* in a manner that allows the installer to pass the hanging wires 300*j* through multiple support rails 120*j*, as illustrated in FIG. 8.

In light of this disclosure, those skilled in the art should appreciate that the decorative slats 110*j* and the support rails 120*j* can have any number of suitable orientations relative to each other. Moreover, the holes in the support rails 120*j* as well as cross-sectional shapes of the decorative slats 110*j* can vary from one implementation to another. Accordingly, rotating or positioning and/or orienting the support rails 120*j* within the holes of the decorative slats 110*j* can allow the installer to secure the decorative multi-slat system 100*j* to any number of suitable support surfaces, which can have any orientation relative to each other as well as relative to the decorative multi-slat system 100*j*.

Figure 9:
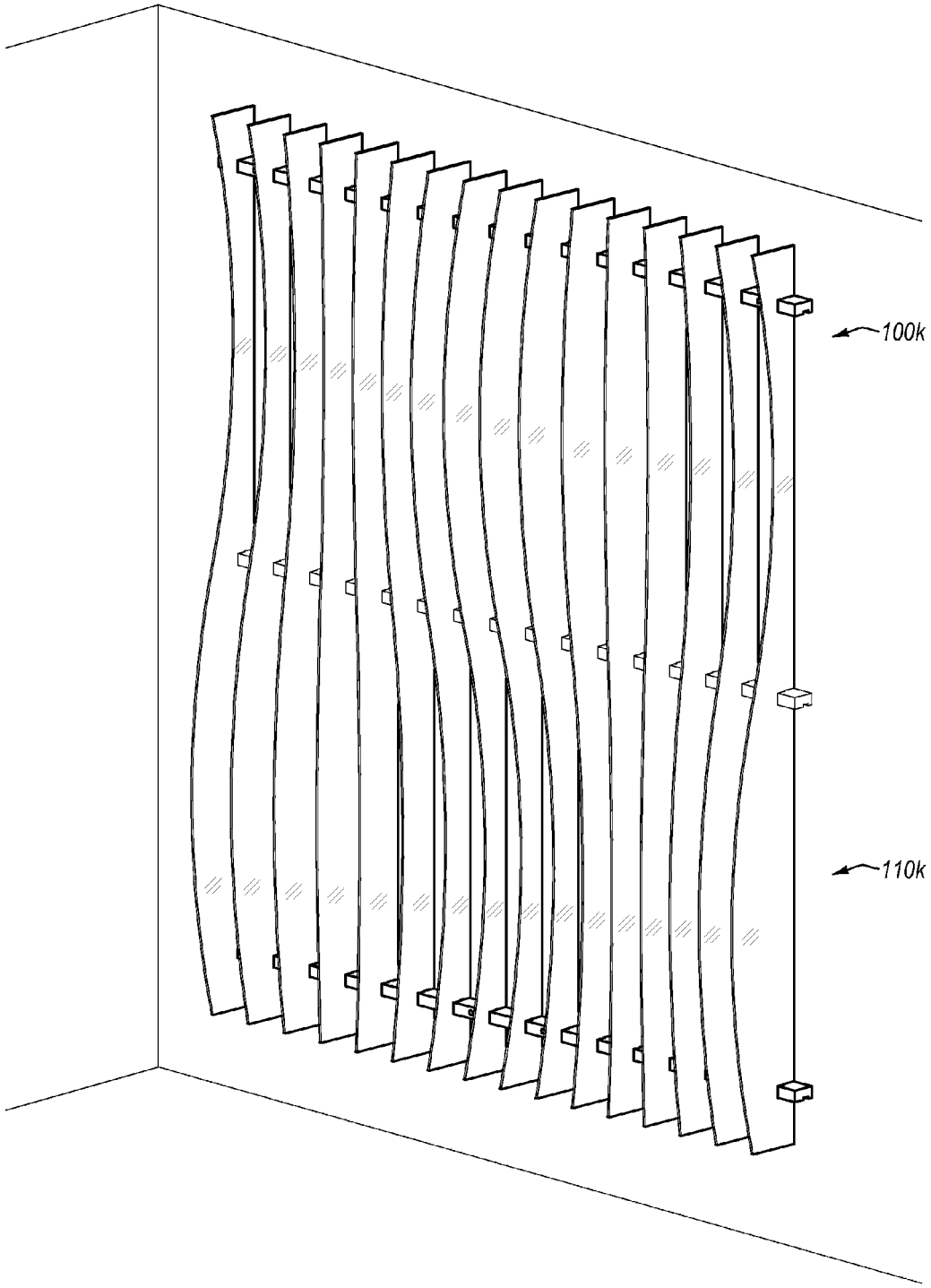
FIG. 9 illustrates a perspective view of a decorative multi-slat system in accordance with another implementation of the present invention.

Moreover, as mentioned above, the decorative slats can have any number of shapes and sizes, which can vary from one implementation to another. Furthermore, shapes of distinct decorative slats within the same decorative multi-slat system can be different from one another. In one or more implementations, as illustrated in FIG. 9, the decorative slats can have nonlinearly varying widths, which can form a curved gradient decorative multi-slat system 100*k*. For example, the width of the decorative slats 110*k* can have substantially arcuate shape (either concave, convex, or a combination of both, such as an S-shape). Additional implementations include curved or bent decorative slats 110*k*. Such decorative slats 110*k* can have continuous or variable curvature. For example, the decorative slats 110*k* can have a curvature that can emulate a wave traveling through the decorative slats 110*k* of the decorative multi-slat system 100*k*. Furthermore, the decorative multi-slat system 100*k* also can include serrated, perforated, or otherwise cut decorative slats.

Moreover, in at least one additional or alternative implementation, shapes of the decorative slats can vary such as to form a decorative multi-slat system that has a straight gradient configuration. In other words, the decorative multi-slat system can have progressively changing widths of the decorative slats, from one decorative slat to the next decorative slat, along the decorative multi-slat system. For instance, the widths of the adjacent decorative slats in the decorative multi-slat system can decrease and then increase.

Similarly, the decorative multi-slat system can have an angular gradient. For instance, widths of one or more portions of the decorative slats can change progressively from one decorative slat to the next (adjacent) decorative slat. Additionally or alternatively, the decorative slats can have changing widths along a length of the decorative slat. The width of the decorative slat can change linearly, creating a sloping, substantially straight edge.

The decorative multi-slat system also can include decorative slats that have various colors and design patterns. For instance, the decorative multi-slat system can include decorative slats that have wood-like pattern. Generally, the decorative slats can comprise any suitable material. Hence, in at least one instance, the decorative multi-slat system can incorporate decorative slats made from wood. Additionally or alternatively, the decorative multi-slat system can incorporate decorative slats that have fabric-like pattern, made from fabric, and/or incorporate fabric.

The decorative slats also can have various positions and orientations on the support rails. For example the installer can position the decorative slats in a manner that aligns the edges thereof. Alternatively, the installer can choose to stager the decorative slats.

The decorative multi-slat system also can have a twisted configuration, such that decorative slats lie in different planes with respect to one another. Alternatively, a decorative multi-slat system with a twisted configuration can have decorative slats that lie in parallel planes, but which have edges positioned at an angle with respect to one another. Accordingly, the twisted decorative multi-slat system can have an in-plane, an out-of-plane, or compound twist formed by the decorative slats therein.

In light of this disclosure, those skilled in the art should appreciate that the designer can incorporate various decorative slats into the decorative multi-slat system. Additionally or alternatively, the decorative multi-slat system can span over a desired area of the support surface—e.g., a portion or entire support surface. Moreover, the decorative slats can span over multiple connecting support surfaces. Implementation of the present invention also provide for the decorative multi-slat system that can include translucent decorative slats, which can filter and/or diffuse light.

Figure 10:
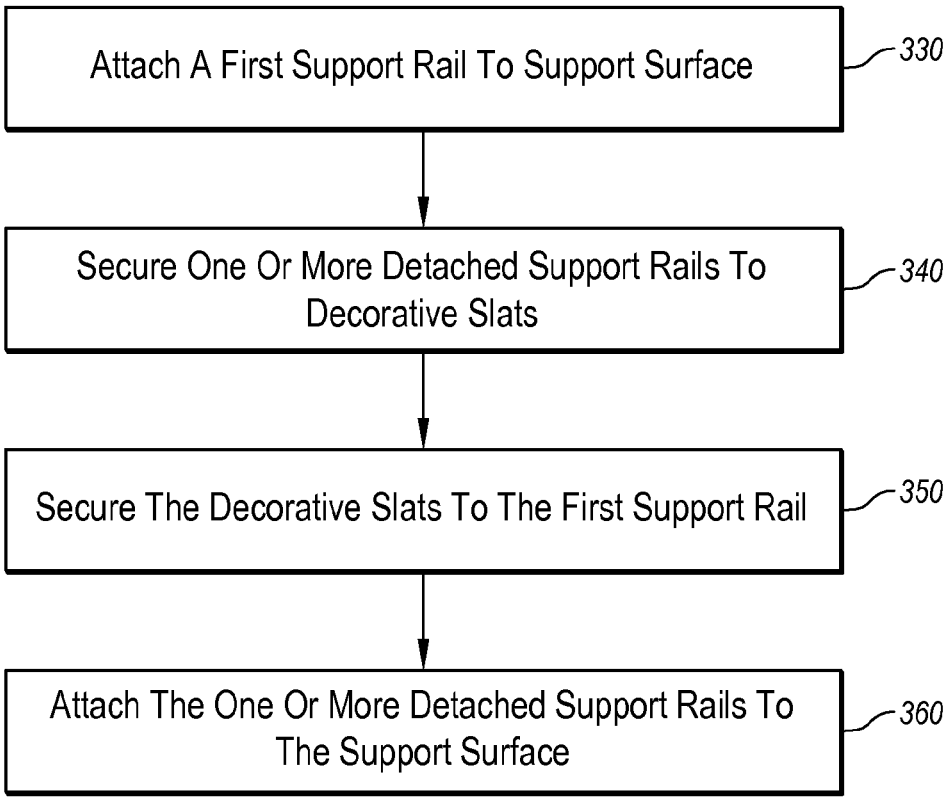
FIG. 10 illustrates a chart of a method for installing a decorative multi-slat system in accordance with one implementation of the present invention.

Accordingly, FIGS. 1-9 and the corresponding text provide a number of different components and mechanisms for creating decorative slats and decorative multi-slat systems. In addition to the foregoing, implementations of the present invention also includes a method of mounting or installing the decorative multi-slat system, which can be described in terms of flowcharts comprising acts and steps in a method for accomplishing a particular result. For example, FIG. 10 illustrates a flowchart of one exemplary method for installing the decorative multi-slat systems. The acts of FIG. 10 are described below with reference to the components and diagrams of FIGS. 1 through 9.

For example, FIG. 8 shows that a method for installing the decorative multi-slat system 100, 100*d*, 100*e*, 100*f*, 100*g*,

100*h*, 100*i*, 100*j*, 100*k* can include an act 330 of attaching a first support rail 120 (e.g., the uppermost support rail 120*a*) to the support surface 130. In one implementation, the installer can position the support rail 120*a* at a desired location on a vertical support surface 130. For instance, the installer can orient the support rail 120*a* (e.g., the installer can level the support rail 120*a*), such that the upper surface of the support rail 120*a* is substantially parallel to the floor that abuts the support surface 130.

In one or more implementations, the installer can fasten the support rail 120*a* with screws or anchors to the support surface 130. Implementations of the present invention also can include an act 340 of securing one or more detached support rails 120 (such as the support rails 120*b*, 120*c*, which can be detached from or unconnected to the support surface) to the decorative slats 110, 110*d*, 110*e*, 110*f*, 110*g*, 110*h*, 110*i*, 110*j*, 110*k* (or vice versa). In other words, the installer can secure decorative slats 110, 110*d*, 110*e*, 110*f*, 110*g*, 110*h*, 110*i*, 110*j*, 110*k* to one or more second support rails.

For example, the installer can secure first and second decorative slats 110, 110*d*, 110*e*, 110*f*, 110*g*, 110*h*, 110*i*, 110*j*, 110*k* to the support rails 120*b*, 120*c*. In one implementation, such first and second decorative slats 110, 110*d*, 110*e*, 110*f*, 110*g*, 110*h*, 110*i*, 110*j*, 110*k* can couple to the support rails 120*b*, 120*c* near opposing ends thereof (e.g., near a left end and/or right end of the support rails 120*b*, 120*c*). As such, the first and second decorative slats 110, 110*d*, 110*e*, 110*f*, 110*g*, 110*h*, 110*i*, 110*j*, 110*k* can provide proper locations for the support rails 120*b*, 120*c* along the lengths of the decorative slats 110, 110*d*, 110*e*, 110*f*, 110*g*, 110*h*, 110*i*, 110*j*, 110*k*. In other words, the decorative slats 110, 110*d*, 110*e*, 110*f*, 110*g*, 110*h*, 110*i*, 110*j*, 110*k* can set accurate spacing between the support rails 120*b*, 120*c*, which can reduce or eliminate misalignment of the support rails 120 and corresponding connection points with the decorative slats 110, 110*d*, 110*e*, 110*f*, 110*g*, 110*h*, 110*i*, 110*j*, 110*k*.

Additionally, the method can include an act 350 of securing the decorative slats 110, 110*d*, 110*e*, 110*f*, 110*g*, 110*h*, 110*i*, 110*j*, 110*k* to the first support rail (e.g., support rail 120*a*). It should be noted that in at least one implementation, the installer can perform the act 350 after performing the act 340. Hence, the first and second decorative slats 110, 110*d*, 110*e*, 110*f*, 110*g*, 110*h*, 110*i*, 110*j*, 110*k* can include the detached support rails 120 (e.g., support rails 120*b*, 120*c*) coupled thereto. Accordingly, after the installer secures the first and second decorative slats 110, 110*d*, 110*e*, 110*f*, 110*g*, 110*h*, 110*i*, 110*j*, 110*k* to the first support rail 120 (e.g., to the support rail 120*a*), the first and second decorative slats 110, 110*d*, 110*e*, 110*f*, 110*g*, 110*h*, 110*i*, 110*j*, 110*k* can have all of the support rails 120 coupled thereto. As such, the first and second decorative slats 110, 110*d*, 110*e*, 110*f*, 110*g*, 110*h*, 110*i*, 110*j*, 110*k* can ensure proper spacing between the support rails 120 for securing and additional decorative slats 110, 110*d*, 110*e*, 110*f*, 110*g*, 110*h*, 110*i*, 110*j*, 110*k* thereto.

The method also can include an act 360 of attaching the detached support rails 120 (e.g., the support rails 120*b*, 120*c*) to the support surface 130. In some instances, the installer can perform the act 350 before performing the act 360. Thus, as noted above, the support rails 120 can have proper spacing therebetween for securing additional decorative slats 110, 110*d*, 110*e*, 110*f*, 110*g*, 110*h*, 110*i*, 110*j*, 110*k*. Therefore, the installer can fasten or secure the support rails 120*b*, 120*c* to the support surface 130, while the decorative slats 110, 110*d*, 110*e*, 110*f*, 110*g*, 110*h*, 110*i*, 110*j*, 110*k* can ensure proper spacing between the support rails 120, which remains substantially fixed. Thereafter, the installer can secure additional decorative slats 110, 110*d*, 110*e*, 110*f*, 110*g*, 110*h*, 110*i*, 110*j*, 110*k* to the support rails 120, to complete the installation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A decorative multi-slat system for use in an architectural environment comprising:

a support surface;

a plurality of support rails secured to the support surface, at least one support rail of the plurality of support rails having a plurality of slits passing therethrough;

a plurality of decorative slats, at least one decorative slat of the plurality of decorative slats being positioned within corresponding slits of the plurality of slits, the at least one decorative slat of the decorative slats being fixedly coupled to the plurality of support rails; and a plurality of mounting members securing the plurality of support rails to the support surface;

wherein:

the at least one decorative slat of the one or more decorative slats is coupled to the plurality of support rails at a predetermined position, and the at least one decorative slat of the one or more decorative slats is coupled to the plurality of support rails at a predetermined orientation relative to the plurality of support rails.

2. The system as recited in claim 1, wherein:

at least one support rail of the plurality of support rails comprises a snap-in channel; and each decorative slat in the plurality of decorative slats comprises at least one corresponding snap-in connector positioned and oriented to snap into the snap-in channel.

3. The system as recited in claim 1, wherein at least one decorative slat of the plurality of decorative slats comprises one or more cutouts shaped and sized to fit around at least a portion of at least one support rail of the plurality of support rails.

4. The system as recited in claim 3, wherein the one or more cutouts are sized to have clearance relative to the portion of the at least one support rail of the plurality of support rails.

5. The system as recited in claim 4, wherein the at least one decorative slat of the plurality of decorative slats comprises at least one centering element pressing against a bottom surface of the at least one support rail of the plurality of support rails and pressing top edges of the one or more cutouts against a top surface of the at least one support rail of the plurality of support rails.

6. The system as recited in claim 3, wherein the snap-in channel is formed in an underside of the support rail.

7. The system as recited in claim 3, wherein:

at least one of the one or more cutouts has no snap-in connector formed therein, but is otherwise configured to receive a shape of one of the support rails; and each decorative slat is configured to be secured to at least one rail with a snap-in connector, and connected to another of the support rails via the at least one cutout without a snap-in connector.

8. The system as recited in claim 3, wherein each snap-in connector comprises a flexible, angled portion configured to flex upon initial engagement with the support rail, and to subsequently deflect into the snap-in channel in the corresponding support rail after the support rail is moved a distance along the flexible, angled portion.

9. The system as recited in claim 8, wherein the snap-in connector further comprises a centering element.

10. The system as recited in claim 8, wherein the snap-in connector further comprises a perforation that, when engaged, allows the snap-in connector to be flexed and withdrawn from the snap-in channel.

11. The system as recited in claim 1, wherein the plurality of decorative slats are spaced apart from each other by substantially the same spaces therebetween.

12. A decorative multi-slat system for use in an architectural environment comprising:

a support surface;

a plurality of support rails secured to the support surface, at least one support rail of the plurality of support rails having a plurality of slits passing therethrough;

a plurality of decorative slats, at least one decorative slat of the plurality of decorative slats being positioned within corresponding slits of the plurality of slits, the at least one decorative slat of the decorative slats being fixedly coupled to the plurality of support rails;

wherein:

the at least one decorative slat of the one or more decorative slats is coupled to the plurality of support rails at a predetermined position, and the at least one decorative slat of the one or more decorative slats is coupled to the plurality of support rails at a predetermined orientation relative to the plurality of support rails;

at least one support rail of the plurality of support rails comprises a snap-in channel; and the plurality of decorative slats comprise snap-in connectors positioned and oriented to snap into the snap-in channel.

13. The system as recited in claim 12, wherein at least one decorative slat of the plurality of decorative slats comprises one or more cutouts shaped and sized to fit around at least a portion of at least one support rail of the plurality of support rails.

14. The system as recited in claim 13, wherein the one or more cutouts are sized to have clearance relative to the portion of the at least one support rail of the plurality of support rails.

15. The system as recited in claim 13, wherein the at least one decorative slat of the plurality of decorative slats comprises at least one centering element pressing against a bottom surface of the at least one support rail of the plurality of support rails and pressing top edges of the one or more cutouts against a top surface of the at least one support rail of the plurality of support rails.

16. The system as recited in claim 13, wherein:

at least one of the one or more cutouts has no snap-in connector formed therein, but is otherwise configured to receive a shape of one of the support rails; and each decorative slat is configured to be secured to at least one rail with a snap-in connector, and connected to another of the support rails via the at least one cutout without a snap-in connector.

17. The system as recited in claim 12, wherein the plurality of decorative slats are spaced apart from each other by substantially the same spaces therebetween.

18. The system as recited in claim 12, wherein the snap-in channel is formed in an underside of the support rail.

19. The system as recited in claim 12, wherein each snap-in connector comprises a flexible angled portion configured to flex upon initial engagement with the support rail, and to subsequently flex into the snap-in channel in the corresponding support rail.

20. The system as recited in claim 19, wherein the snap-in connector further comprises a centering element.

21. A decorative multi-slat system for use in an architectural environment comprising:

a support surface;

a plurality of support rails secured to the support surface, at least one support rail of the plurality of support rails having a plurality of slits passing therethrough;

a plurality of decorative slats, at least one decorative slat of the plurality of decorative slats being positioned within corresponding slits of the plurality of slits, the at least one decorative slat of the decorative slats being fixedly coupled to the plurality of support rails;

wherein:

the at least one decorative slat of the one or more decorative slats is coupled to the plurality of support rails at a predetermined position;

the at least one decorative slat of the one or more decorative slats is coupled to the plurality of support rails at a predetermined orientation relative to the plurality of support rails;

at least one decorative slat of the plurality of decorative slats comprises one or more cutouts shaped and sized to fit around at least a portion of at least one support rail of the plurality of support rails;

the one or more cutouts are sized to have clearance relative to the portion of the at least one support rail of the plurality of support rails; and the at least one decorative slat comprises at least one centering element pressing against a bottom surface of the at least one support rail of the plurality of support rails and pressing top edges of the one or more cutouts against a top surface of the at least one support rail of the plurality of support rails.

22. The system as recited in claim 21, wherein at least one decorative slat of the plurality of decorative slats comprises one or more cutouts shaped and sized to fit around at least a portion of at least one support rail of the plurality of support rails.

23. The system as recited in claim 21, wherein the plurality of decorative slats are spaced apart from each other by substantially the same spaces therebetween.

24. The system as recited in claim 21, further comprising a snap-in channel formed in an underside of one or more of the support rails.

25. The system as recited in claim 24, wherein each decorative slat further comprises a snap-in connector having a flexible, angled portion configured to flex upon initial engagement with the support rail, and to subsequently flex into the snap-in channel in the corresponding support rail.

26. The system as recited in claim 25, wherein:

at least one of the one or more cutouts has no snap-in connector formed therein, but is otherwise configured to receive a shape of one of the support rails; and each decorative slat is configured to be secured to at least one rail with a snap-in connector, and connected to another of the support rails via the at least one cutout without a snap-in connector.

* * * * *